US005765094A

United States Patent [19]

Nakamura

[11] Patent Number: 5,765,094

[45] Date of Patent: Jun. 9, 1998

[54] APPARATUS FOR HOLDING RECORDING SHEETS ON AN IMAGE RECORDING APPARATUS

[75] Inventor: Hideyasu Nakamura, Ebina, Japan

[73] Assignee: Fuji Xerox Co., Ltd., Tokyo, Japan

[21] Appl. No.: 732,981

[22] Filed: Oct. 16, 1996

[30] Foreign Application Priority Data

Oct. 20, 1995 [JP] Japan ..... 7-297898
Oct. 16, 1996 [JP] Japan ..... 8-293133

[51] Int. Cl.[6] ..... G03G 21/00

[52] U.S. Cl. ..... 399/406; 399/298; 399/389

[58] Field of Search ..... 399/298, 303, 399/389, 406

[56] References Cited

U.S. PATENT DOCUMENTS

| | | | |
|---|---|---|---|
| 5,075,732 | 12/1991 | Menjo . | |
| 5,132,736 | 7/1992 | Muramatsu et al. . | |
| 5,333,038 | 7/1994 | Mizoguchi et al. . | |
| 5,335,056 | 8/1994 | Muramatsu . | |
| 5,481,365 | 1/1996 | Arimoto | 358/296 |
| 5,523,829 | 6/1996 | Miyashiro et al. . | |
| 5,565,970 | 10/1996 | Suda . | |
| 5,619,746 | 4/1997 | Kubo et al. | 399/297 |

FOREIGN PATENT DOCUMENTS

| | | |
|---|---|---|
| 60-252380 | 12/1985 | Japan . |
| 62-279361 | 12/1987 | Japan . |
| 2-6984 | 1/1990 | Japan . |
| 4-136879 | 5/1992 | Japan . |
| 4-337751 | 11/1992 | Japan . |
| 4-337752 | 11/1992 | Japan . |
| 6-337568 | 12/1994 | Japan . |

*Primary Examiner*—R. L. Moses
*Attorney, Agent, or Firm*—Oliff & Berridge PLC

[57] ABSTRACT

An image recording apparatus comprises an image carrier (1); a latent image forming means (2); a plurality of developing means (3: 3*a*, 3*b*, 3*c* and 3*d*); a transfer drum (5) having a sheet holding surface (A); a transfer means (6); a sheet feed means (11); a sheet type discriminating means (12) for discriminating whether or not the surface rigidity of the recording sheet (4) stacked on the sheet feed means (11) is higher than the reference surface rigidity; a curl deforming means (14) arranged in a conveyance passage of the recording sheet (4) from the sheet feed means (11) to the transfer drum (5), for forcibly curling the recording sheet (4) in accordance with a radius of curvature of the transfer drum (5) when it is discriminated by the sheet type discriminating means (12) that the recording sheet (4) is highly rigid; a sheet holding control means (19) for holding the recording sheet (4) on the same sheet holding surface (A) of the transfer drum (5) irrespective of the result of discrimination conducted by the sheet type discriminating means (12); and an image forming process control means (16) for controlling the transfer of the toner image of each color from the image carrier (1) onto the recording sheet (4) held on the transfer drum (5).

15 Claims, 19 Drawing Sheets

APPARATUS FOR HOLDING RECORDING SHEETS ON AN IMAGE RECORDING APPARATUS

BACKGROUND OF THE INVENTION

The present invention relates to an image recording apparatus in which toner images of multiple colors are multiply transferred onto a recording sheet trained and held round a transfer drum. Particularly, the present invention relates to improvements in an image recording apparatus in which a recording sheet of high rigidity such as a sheet of card board, a post card or an envelope is held on a transfer drum. More particularly, the present invention relates to improvements in an image recording apparatus in which two recording sheets are simultaneously held on the transfer drum so that image recording can be carried out on the two recording sheets.

Conventionally, there is provided an image forming apparatus in which a photoreceptor drum, which is an image carrier, and a transfer drum are synchronously rotated, and toner images of multiple colors are multiply transferred and fixed from the photoreceptor drum onto a recording sheet held on the transfer drum.

In this type image recording apparatus, conventionally, the overall sequence is controlled on the basis of the transfer drum (shown in Japanese Unexamined Patent Publication 62- 279361).

In the above image forming apparatus, image recording operation is conducted as follows. The transfer drum is usually provided with a metallic tie-bar extending in the axial direction of the transfer drum, wherein this tie-bar forms a portion of the drum frame. In a portion on the transfer drum corresponding to the tie-bar, it is impossible to conduct a transfer operation on a recording sheet. Therefore, the position of the tie-bar is used as a base of the overall sequence. Accordingly, all image recording operations such as an exposure scanning operation, a recording sheet feed operation to feed a recording sheet to the transfer drum, a transfer position matching operation to match the recording sheet held on the transfer drum with the toner image formed on the photoreceptor drum (ON/OFF operation of the transfer corotron incorporated into the transfer drum), and a separating operation of the recording sheet to separate the recording sheet from the transfer drum, are controlled on the basis of the tie-bar, that is, the tie-bar is used as a base of all sequence.

In this connection, in order to meet a demand of increasing the image recording speed in this type image recording apparatus, the following operation is disclosed in Japanese Unexamined Patent Publication 2-6984 and 4-337751. For example, two recording sheets of size A4 are attracted and held on the two sheet holding surfaces A and B of the transfer drum. On these two recording sheets which are simultaneously trained round the transfer drum, the processes of exposure, development and transfer are conducted for each color component in the order of the sheet holding surfaces A and B on the transfer drum.

However, in this type image recording apparatus in which two recording sheets are simultaneously trained round the transfer drum, the usable recording sheets are limited to sheets of paper, the rigidity of which is low, such as sheets of common paper. That is, sheets of paper, the rigidity of which is high, such as sheets of card board, post cards and envelopes can not be applied to this type image recording apparatus. The reason is described as follows. When a sheet of paper of high rigidity is held on the sheet holding surface A, a leading end of the recording sheet is raised by its rigidity, which could be a cause of failure in tacking.

In order to solve the above technical problem, the following countermeasures are conventionally taken. A position on the transfer drum behind the leading end reference position of the sheet holding surface A is determined to be a leading end reference position of the sheet holding surface on which a highly rigid recording sheet is held. In the image formation to be conducted on a highly rigid recording sheet, only one recording sheet is trained round the transfer drum. For this reason, when an image is recorded on a highly rigid recording sheet, it is necessary to conduct an image recording control operation different from that of a sheet of common paper. Therefore, even if the size of a recording sheet is small, it is difficult to enhance the productivity.

Since the sheet holding surface on which a highly rigid recording sheet is held is located behind the leading end reference position, the maximum size of a highly rigid recording sheet that can be held on the sheet holding surface A is smaller than that of a sheet of common paper.

The heat capacity of a recording sheet such as a sheet of card board is large. Accordingly, there has been already provided an image recording apparatus in which the fusing speed of a fusing unit can be changed over in accordance with the type of a recording sheet so that the toner image fusing property of the image recording apparatus can be enhanced when images are recorded on various types of recording sheets (shown in Japanese Unexamined Patent Publication 60- 252380).

In this type image recording apparatus, it is necessary to change over the fusing speed to a lower speed when image recording is conducted on recording sheets such as sheets of card board. In this case, the transfer speed (process speed) of the transfer drum is a normal speed. Therefore, it is necessary to provide a means for absorbing a difference of speed when a recording sheet such as a sheet of card board is conveyed from the transfer drum to the fusing unit. In order to absorb the speed differences the conventional image recording apparatus is provided with a transport means between the transfer drum and the fusing unit. The above transport means must be operated in such a manner that the speed is reduced at a point of time when the transport means receives a recording sheet separated from the transfer drum which rotates at a normal speed and the recording sheet is sent into the fusing unit at a reduced speed. Accordingly, the length of the transport means must be determined as (Length of the recording sheet+some distance required for the speed reduction).

Inevitably, it is difficult to make the image recording apparatus compact.

In this type image recording apparatus in which two sheets of recording paper are simultaneously trained round the transfer drum, usually, the size of recording sheets accommodated in the sheet feed cassette is previously set, and the mode of image recording in which two sheets of recording paper are simultaneously trained round the transfer drum is carried out for the recording sheets fed from the sheet feed cassette in which the sheets of recording paper concerned are accommodated.

Accordingly, for example, when a hand feed tray is used, in which various sizes of recording sheets are accommodated, it is impossible to previously discriminate whether or not the recording sheets can be simultaneously trained about the transfer drum. For this reason, concerning the recording sheets fed from the hand feed tray, it is impossible to realize the mode of image recording in which two sheets of recording paper are simultaneously trained round the transfer drum.

In the case of a sheet feed cassette having no sensor to detect the size of recording sheets, or in the case where different sizes of recording sheets are temporarily accommodated in a sheet feed cassette even when the sheet feed cassette has a sensor to detect the size of recording sheets, it is impossible in the same manner as described above to realize the mode of image recording in which two sheets of recording paper are simultaneously trained round the transfer drum.

SUMMARY OF THE INVENTION

The present invention has been accomplished to solve the above technical problems. A first object of the present invention is to provide an image recording apparatus in which even a recording sheet of high rigidity can be held at the leading end reference position on the sheet holding surface A of the transfer drum, so that the applicability of the size of recording sheets can be extended and the image forming process control can be conducted in common.

A second object of the present invention is to provide an image recording apparatus in which even two recording sheets of high rigidity can be simultaneously held on the transfer drum, so that the image recording speed can be increased.

A third object of the present invention is to provide an image recording apparatus in which even two recording sheets of high rigidity can be simultaneously held on the transfer drum, so that the image recording speed can be increased, and the toner fusing property can be maintained high with respect to the image recording sheets of high rigidity, the heat capacity of which is large, while the transport means for absorbing a difference between the transfer speed and the fusing speed is not required.

A fourth object of the present invention is to provide an image recording apparatus in which two recording sheets can be simultaneously held on the transfer drum even in the case where the size of recording sheets accommodated in the sheet feed means can not be previously detected, so that the applicability of the size of recording sheets can be extended.

In order to realize the first task, the present invention (the first aspect of the invention) is to provide an image recording apparatus comprising: an image carrier; a latent image forming means for successively forming an electrostatic latent image of each color component on the image carrier; a plurality of developing means respectively containing toner of each color component, selectively arranged around the image carrier; a transfer drum having a sheet holding surface on which a recording sheet is held, rotated synchronously with the image carrier so that a recording sheet can be held on the sheet holding surface; a transfer means for transferring a toner image of each color from the image carrier onto the recording sheet held by the transfer drum; a sheet feed means for successively feeding the recording sheet stacked on it; a sheet type discriminating means for discriminating whether or not the surface rigidity of the recording sheet stacked on the sheet feed means is higher than the reference surface rigidity; a curl deforming means arranged in a conveyance passage of the recording sheet from the sheet feed means to the transfer drum, for forcibly curling the recording sheet in accordance with a radius of curvature of the transfer drum when it is discriminated by the sheet type discriminating means that the recording sheet is highly rigid; a sheet holding control means for holding the recording sheet on the same sheet holding surface of the transfer drum irrespective of the result of discrimination conducted by the sheet type discriminating means; and an image forming process control means for controlling the transfer of the toner image of each color from the image carrier onto the recording sheet held on the transfer drum.

In order to realize the second task, the present invention (the second aspect of the invention) is to provide an image recording apparatus comprising: an image carrier; a latent image forming means for successively forming an electrostatic latent image of each color component on the image carrier; a plurality of developing means respectively containing toner of each color component, selectively arranged around the image carrier; a transfer drum having two semicircular sheet holding surfaces on which two recording sheets are held, rotated synchronously with the image carrier so that one or two recording sheets can be held on the sheet holding surfaces; a transfer means for transferring a toner image of each color from the image carrier onto the recording sheet held by the transfer drum; a sheet feed means for successively feeding the recording sheet stacked on it; a sheet type discriminating means for discriminating whether or not the surface rigidity of the recording sheet stacked on the sheet feed means is higher than the reference surface rigidity; a sheet size detecting means for detecting a size of the recording sheet fed from the sheet feed means; a curl deforming means arranged in a conveyance passage of the recording sheet: from the sheet feed means to the transfer drum, for forcibly curling the recording sheet in accordance with a radius of curvature of the transfer drum when it is discriminated by the sheet type discriminating means that the recording sheet is highly rigid; a sheet holding control means for determining whether one or two recording sheets are held on the photoreceptor drum in accordance with the size information of the recording sheet detected by the sheet size detecting means, the sheet holding control means also for controlling to hold the recording sheet on the transfer drum in accordance with the determination of holding the recording sheet; and an image forming process control means for controlling the transfer of the toner image of each color from the image carrier onto the recording sheet held on the transfer drum.

In order to realize the third task, the present invention (the third aspect of the invention) is to provide an image recording apparatus comprising: an image carrier; a latent image forming means; a plurality of developing means; a transfer drum; a transfer means; a sheet separating means for separating the recording sheet, onto which the toner image of each color has been transferred by the transfer means, from the transfer drum; a thermal fusing means for fusing the toner image of each color formed on the recording sheet separated from the transfer drum by the sheet separating means; a sheet feed means; a sheet type discriminating means; a sheet size detecting means; a curl deforming means; a sheet holding control means; an image forming process control means; and a sheet separating fusing control means for controlling to separate the recording sheet by the sheet separating means at a point of time when the final color toner image is being transferred onto one or two recording sheets on the transfer drum or at a point of time when the transfer of the final color toner image onto one or two recording sheets on the transfer drum has been completed, the sheet separating fusing control means also for controlling to fuse the toner image by the thermal fusing means; and a speed change-over control means for operating when the sheet type discriminating means has discriminated that the recording sheet is highly rigid, the speed change-over control means also for changing over the rotating speed of the transfer drum and the fusing speed of the thermal fusing means to a speed lower than the normal speed at a point of time when the final color toner image has been transferred onto the recording sheet and before the recording sheet enters the thermal fusing means.

In order to realize the fourth task, the present invention (the fourth aspect of the invention) is to provide an image recording apparatus comprising: an image carrier; a latent image forming means; a plurality of developing means; a transfer drum; a transfer means; a sheet separating means for separating the recording sheet, onto which the toner image of each color has been transferred by the transfer means, from the transfer drum; a thermal fusing means for fusing the toner image of each color formed on the recording sheet separated from the transfer drum by the sheet separating means; a sheet feed means for successively feeding the recording sheet stacked on it; a sheet size detecting means arranged in a conveyance passage of the recording sheet between the sheet feed means and the transfer drum, for detecting the size of the recording sheet conveyed by the sheet feed means; a sheet holding control means for determining whether one or two recording sheets are held on the photoreceptor drum in accordance with the size information of the recording sheet detected by the sheet size detecting means, the sheet holding control means also for controlling to hold the recording sheet on the transfer drum in accordance with the determination of holding the recording sheet; and an image forming process control means for controlling the transfer of the toner image of each color from the image carrier onto the recording sheet held on the transfer drum 5.

DETAILED DESCRIPTION OF THE PREFERRED EMBODIMENTS

Figure 1:
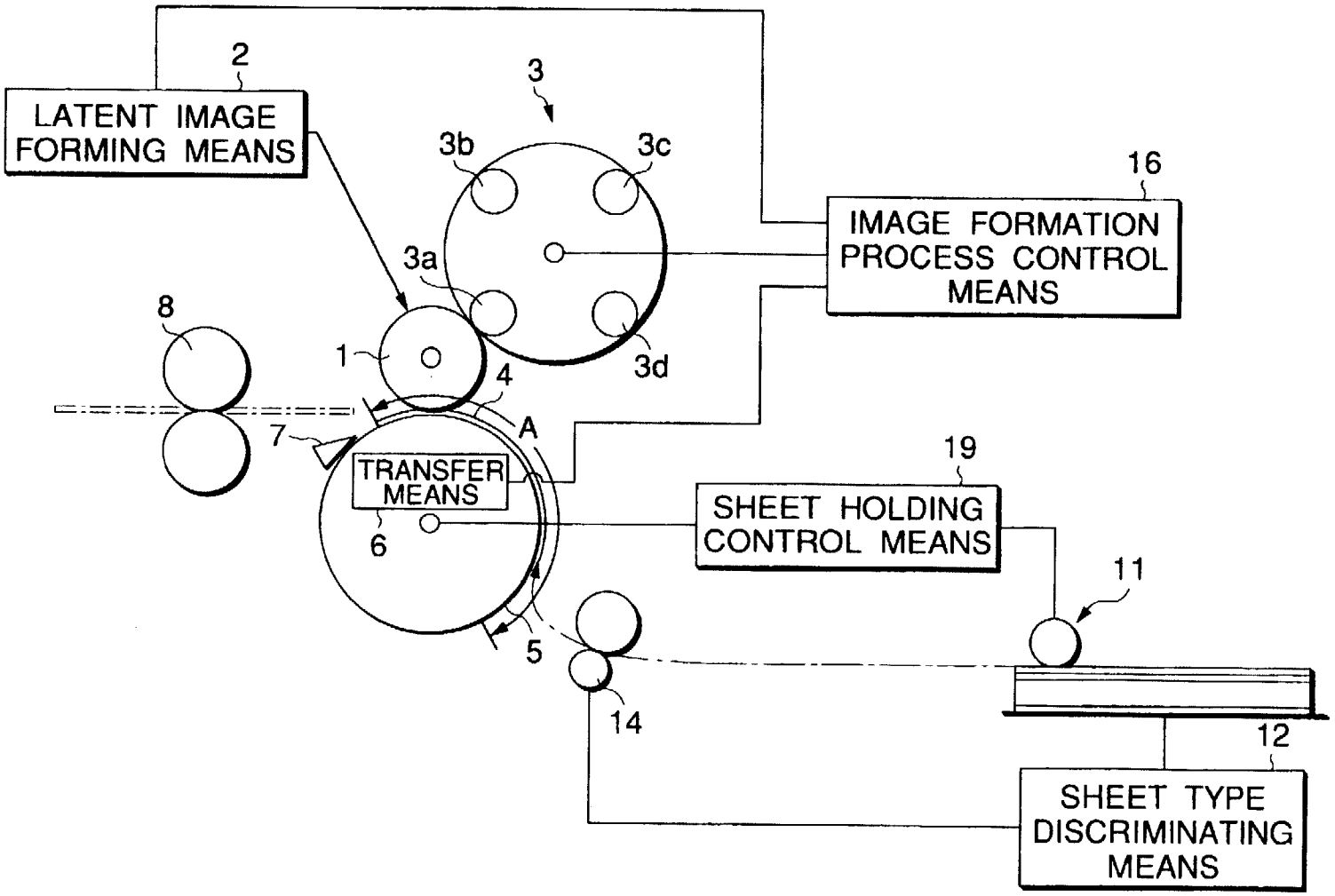
FIG. 1 is a schematic illustration showing an arrangement of the image forming apparatus of the present invention.

As shown in FIG. 1, an image recording apparatus of an embodiment comprises: an image carrier 1; a latent image forming means 2 for successively forming an electrostatic latent image of each color component on the image carrier 1; a plurality of developing means 3 (for example, 3*a*, 3*b*, 3*c* and 3*d*) respectively containing toner of each color component, selectively arranged around the image carrier 1; a transfer drum 5 having a sheet holding surface A on which a recording sheet 4 is held, rotated synchronously with the image carrier 1 so that a recording sheet 4 can be held on the sheet holding surface A; a transfer means 6 for transferring a toner image of each color from the image carrier 1 onto the recording sheet 4 held by the transfer drum 5; a sheet feed means 11 for successively feeding the recording sheet 4 stacked on it; a sheet type discriminating means 12 for discriminating whether or not the surface rigidity of the recording sheet 4 stacked on the sheet feed means 11 is higher than the reference surface rigidity; a curl deforming means 14 arranged in a conveyance passage of the recording sheet 4 from the sheet feed means 11 to the transfer drum 5, for forcibly curling the recording sheet 4 in accordance with a radius of curvature of the transfer drum 5 when it is discriminated by the sheet type discriminating means 12 that the recording sheet 4 is highly rigid; a sheet holding control means 19 for holding the recording sheet 4 on the same sheet holding surface A of the transfer drum 5 irrespective of the result of discrimination conducted by the sheet type discriminating means 12; and an image forming process control means 16 for controlling the transfer of the toner image of each color from the image carrier 1 onto the recording sheet 4 held on the transfer drum 5.

Figure 2:
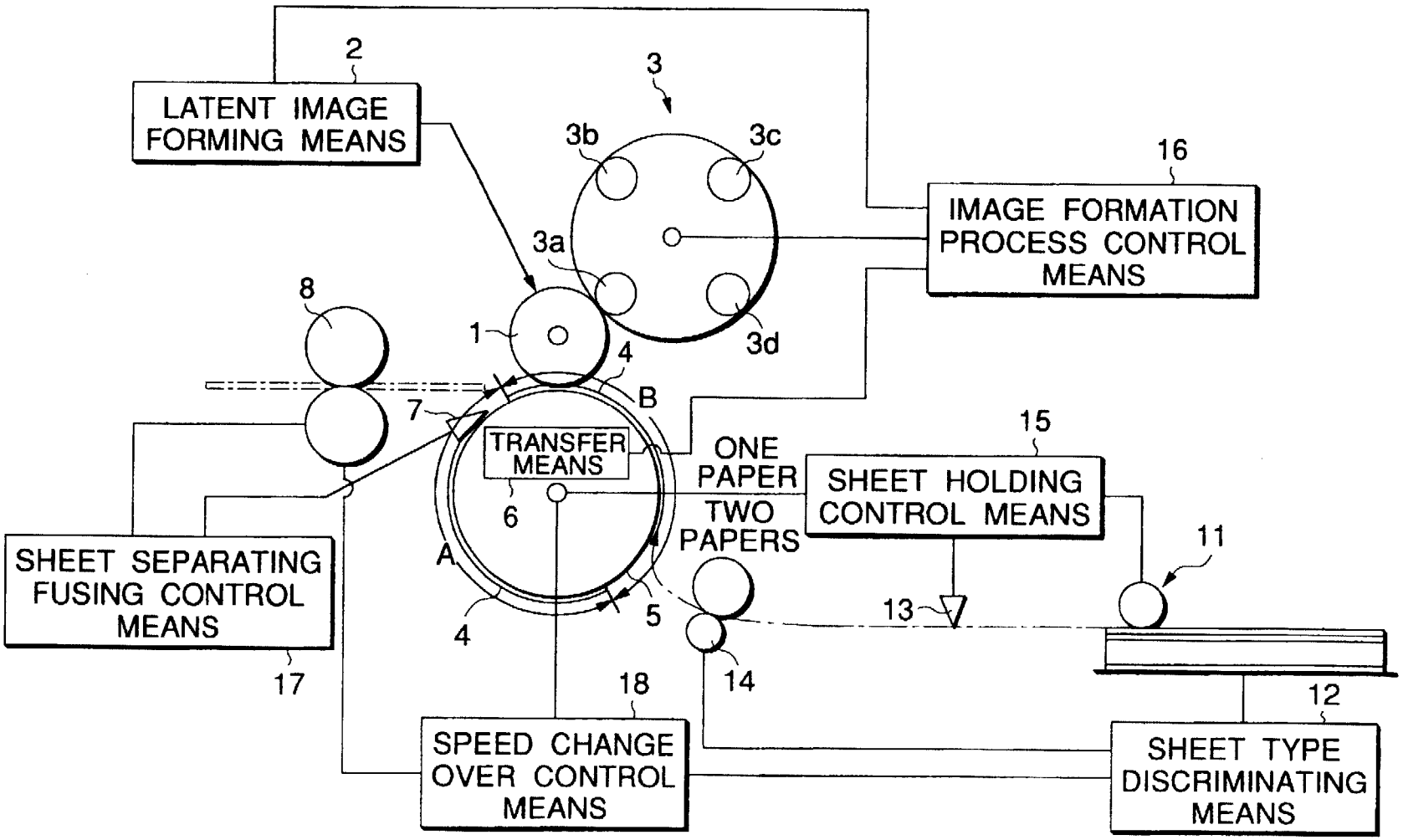
FIG. 2 is a schematic illustration showing another arrangement of the image forming apparatus of the present invention.

As shown in FIG. 2, an image recording apparatus of another embodiment comprising: an image carrier 1; a latent image forming means 2 for successively forming an electrostatic latent image of each color component on the image carrier 1; a plurality of developing means 3 (for example, 3*a*, 3*b*, 3*c* and 3*d*) respectively containing toner of each color component, selectively arranged around the image carrier 1; a transfer drum 5 having two semicircular sheet holding surfaces A, B on which two recording sheets 4 are held, rotated synchronously with the image carrier 1 so that one or two recording sheets 4 can be held on the sheet holding surfaces A, B; a transfer means 6 for transferring a toner image of each color from the image carrier 1 onto the recording sheet 4 held by the transfer drum 5; a sheet feed means 11 for successively feeding the recording sheet 4 stacked on it; a sheet type discriminating means 12 for discriminating whether or not the surface rigidity of the recording sheet 4 stacked on the sheet feed means 11 is higher than the reference surface rigidity; a sheet size detecting means 13 for detecting a size of the recording sheet 4 fed from the sheet feed means 11; a curl deforming means 14 arranged in a conveyance passage of the recording sheet 4 from the sheet feed means 11 to the transfer drum 5, for forcibly curling the recording sheet 4 in accordance with a radius of curvature of the transfer drum 5 when it is discriminated by the sheet type discriminating means 12 that the recording sheet 4 is highly rigid; a sheet holding control means 15 for determining whether one or two recording sheets 4 are held on the photoreceptor drum 5 in accordance with the size information of the recording sheet 4 detected by the sheet size detecting means 13, the sheet holding control means 15 also for controlling to hold the recording sheet 4 on the transfer drum 5 in accordance with the determination of holding the recording sheet 4; and an image forming process control means 16 for controlling the transfer of the toner image of each color from the image carrier 1 onto the recording sheet 4 held on the transfer drum 5.

As shown in FIG. 2, the image recording apparatus further comprises: a sheet separating means 7 for separating the recording sheet 4, onto which the toner image of each color has been transferred by the transfer means 6, from the transfer drum 5; a thermal fusing means 8 for fusing the toner image of each color formed on the recording sheet 4 separated from the transfer drum 5 by the sheet separating means 7; a sheet separating fusing control means 17 for controlling to separate the recording sheet 4 by the sheet separating means 7 at a point of time when the final color toner image is being transferred onto one or two recording sheets 4 on the transfer drum 5 or at a point of time when the transfer of the final color toner image onto one or two recording sheets 4 on the transfer drum 5 has been completed, the sheet separating fusing control means 17 also for controlling to fuse the toner image by the thermal fusing means; and a speed change-over control means 18 for operating when the sheet type discriminating means 12 has discriminated that the recording sheet 4 is highly rigid, the speed change-over control means 18 also for changing over the rotating speed of the transfer drum 5 and the fusing speed of the thermal fusing means 8 to a speed lower than the normal speed at a point of time when the final color toner image has been transferred onto the recording sheet 4 and before the recording sheet 4 enters the thermal fusing means 8.

In the above technical means, as long as a latent image can be formed on the image carrier 1 and a toner image, which is obtained when the latent image is made to be visual, can be held on the image carrier 1, it is possible to use an appropriate photoreceptor or dielectrics for the image carrier 1. Concerning the shape of the image carrier 1, it is possible to use a drum-shaped image carrier or a belt-shaped image carrier.

Concerning the latent image forming means 2, as long as the latent image forming means 2 can form a latent image corresponding to each color component in accordance with the type of the image carrier 1, the latent image may be formed by means of light beams or ion beams. Concerning the latent image to be formed, the original image may be read and the latent image may be formed in accordance with the image which has been read. Alternatively, the latent image may be formed in accordance with an image signal which has been previously prepared.

Concerning the developing means 3, it is possible to use a developing means capable of conducting color reproduction in accordance with the image recording mode (for example, the 4 color mode, 3 color mode and so on). Concerning the replacing system of the developing means 3, the rotary replacing system may be used in which the developing means 3 is rotatably arranged so as to be rotated appropriately, or the parallel selecting system may be used in which the developing means are arranged in parallel in the periphery of the image carrier 1 so as to be selected appropriately.

Concerning the arrangement of the transfer drum 5, the first aspect of the invention is not necessarily limited to an image recording apparatus in which two recording sheets 4 are simultaneously held on the transfer drum, however, the second to the fourth aspects of the invention are limited only to an image recording apparatus in which two recording sheets 4 are simultaneously held on the transfer drum.

In this case, concerning the recording sheet holding system of the transfer drum 5, an appropriate system such as a system in which a recording sheet is held on the transfer drum 5 by the gripper and the electrostatic attraction force may be adopted. However, from the viewpoint of extending an image transfer region with respect to the recording sheet 4, it is preferable that the recording sheet 4 is held only by the electrostatic attraction force.

Setting of the sheet holding surfaces A, B on the transfer drum 5 on which two recording sheets are simultaneously held may be determined in such a manner that the sheet holding surfaces A, B are set in a region of a half revolution of the transfer drum 5 on the basis of the tie-bar of the transfer drum 5. However, at a position on the transfer drum 5 corresponding to the tie-bar, it is impossible to conduct a recording operation on the recording sheet 4. Accordingly, it is preferable that the size of the tie-bar in the circumferential direction of the transfer drum 5 is reduced as small as possible in the design.

The size of the transfer drum 5 is preferably determined so that the replacing cycle time of the developing means 3 can be ensured when at least the recording sheet 4 of the maximum size is held on the transfer drum 5 in the cycle of one revolution.

Concerning the sheet separating means 7, as long as the sheet separating means can be operated in timed relation with the separation of the recording sheet 4 and it is possible to separate the recording sheet 4 from the transfer drum 5, any type sheet separating means may be selected in the design. For the purpose of enhancing the separation performance of the separating means, it is possible to combine a separation finger, a corotron and a roller for pushing a recording sheet additionally used to separate the recording sheet.

Concerning the sheet feed means 11, as long as it is possible to feed the recording sheet 4 accommodated in it, the sheet feed means is not limited to a hand feed tray, but a sheet feed cassette may be used.

Concerning the sheet type selecting means 12, as long as it is possible to discriminate whether or not the surface rigidity of a recording sheet 4 is higher than the reference rigidity, for example, the surface rigidity may be discriminated by a switching operation conducted on a console panel, or alternatively the surface rigidity may be discriminated by means of a sheet thickness sensor. In this case, the number of types of the recording sheets 4 may be at least one, the surface rigidity of which is different from the reference value. However, the number of types of the recording sheets 4 may be plural in accordance with the degree of surface rigidity.

Concerning the sheet size detecting means 13, as long as it is possible to detect the size of the recording sheet 4 to be conveyed, any type sheet size detecting means may be used. However, in the case where the size of the recording sheet 4 fed from the hand feed tray is detected, it is impossible to directly specify the size of the sheet 4. Therefore, a sensor to detect the sheet size may be arranged in the conveyance passage from the hand feed tray to the transfer drum 5, so that the size of the recording sheet 4 can be detected.

However, the sheet size detecting means 13 used in the fourth aspect of the invention must be arranged as follows. On the assumption that the size of the recording sheet 4 accommodated in the sheet feed means 11 can not be perfectly detected there, the recording sheet size is detected by a detecting means provided in the conveyance passage to convey the recording sheet 4 from the sheet feed means 11 to the transfer drum 5.

Concerning the curl deforming means 14, as long as it is provided in the conveyance passage of the recording sheet 4 from the sheet tray to the transfer drum 5, and as long as the recording sheet 4 can be curled in accordance with a radius of curvature of the transfer drum 5, any type curl deforming means may be adopted. In this case, the degree of curl may be adjusted in accordance with a change in the environmental factors such as humidity.

Concerning the sheet holding control means 19 of the first aspect of the invention, as long as it is possible to hold the recording sheet 4 on the sheet holding surface A irrespective of the result of discrimination conducted by the sheet type discriminating means 12 for discriminating whether or not the surface rigidity of the recording sheet 4 is higher than the reference surface rigidity, any type sheet holding control means may be adopted.

On the other hand, concerning the sheet holding control means 15 of the second to the fourth aspect of the invention, as long as it is possible to automatically determine whether one or two recording sheets are held on the transfer drum in accordance with the size of the recording sheet 4 when the same color print or copy is conducted on a plurality of recording sheets 4, any type sheet holding control means may be adopted.

In this case, the operation may be conducted as follows. A holding cycle to hold the recording sheet 4 on the transfer drum 5 is ensured. In this holding cycle, it is judged by the sheet size detecting means 13 whether or not the size of the first recording sheet 4 is appropriate for the operation in which two recording sheets are simultaneously held on the transfer drum. When the size of the first recording sheet 4 is appropriate for the operation in which two recording sheets are simultaneously held on the transfer drum, the recording sheet 4 is held on the sheet holding surface A. The size of the second recording sheet 4 is estimated to be the same size, and the second recording sheet 4 is held on the sheet holding surface B.

In this connection, when the sheet size detecting means 13 detects that both the length and the width of the second recording sheet 4 are different from those of the first recording sheet 4, the following operation may be conducted. For example, the latent image forming region of the latent image forming means 2 is quickly reset at the size of the second recording sheet 4 so that the transfer drum 5 can be prevented from being stained with developing toner. At the same time, feeding of the following recording sheet 4 is stopped. Alternatively, after the second recording sheet 4 has been attracted onto the transfer drum 5, the apparatus makes an emergency stop.

Concerning the image forming process control means 16, as long as latent image forming operation, developing operation and transfer operation are conducted in accordance with the manner of holding the recording sheet 4 on the transfer drum 5, that is, in accordance with whether one recording sheet is held on the transfer drum 5 or two recording sheets are simultaneously held on the transfer drum 5, any type image forming process control means can be adopted.

Concerning the sheet separating fusing control means 17, as long as the time of separation conducted by the sheet separation means 7 can be controller and also the fusing operation conducted by the thermal fusing means 8 can be controlled, the design of the sheet separating fusing control means 17 may be appropriately changed. However, in the embodiment according to the invention in which the rotating speed of the transfer drum 5 and the fusing speed of the thermal fusing means 8 are simultaneously changed over by the speed change-over control means 18, the recording sheet 4 may be separated from the transfer drum in timed relation, so that the transfer operation conducted on the recording sheet 4 is not hindered from the change-over of the speed.

Accordingly, in the case in which two transfer sheets are simultaneously held on the transfer drum, the first recording sheet 4 may be separated at first. In this case, the second recording sheet 4 may be separated at first. From the viewpoint of reducing the idle rotation of the transfer drum 5 as small as possible, it is preferable that the second recording sheet 4 is separated at first when two transfer sheets are simultaneously held on the transfer drum 5.

Concerning the speed change-over control means 18, the speed may be changed over at least in accordance with the type of the recording sheet 4. The number of speeds to which the recording speed is changed over may be one or plural.

In this case, it is preferable that the recording speed is returned to a normal process speed as quickly as possible immediately after the fusion of the image formed on the recording sheet has been completed when one recording sheet or two recording sheets are simultaneously held on the transfer drum 5.

In this connection, the speed change-over control means 18 is a requisite component of the invention. Accordingly, in the embodiments of the invention in which it is necessary to changed over the fusing speed to a lower value in the case where the recording sheet 4 of high rigidity is processed, it is preferable to provide a transport means for absorbing a difference of speed.

Next, the mode of operation of the image recording apparatus of the present invention will be explained as follows.

First, the first embodiment of the invention is explained here. Referring to FIG. 1, a recording sheet 4 is fed by the sheet feed means 11, and the sheet holding control means 19 makes the recording sheet 4 to be held on the sheet holding surface A of the transfer drum 5.

At this time, the sheet type discriminating means 12 discriminates whether or not the surface rigidity of the recording sheet 4 is higher than the reference value. When the recording sheet 4 is a sheet of card board, the rigidity of which is high, the curl deformation means 14 is operated, so that the recording sheet 4 is forcibly curled in accordance with a radius of curvature of the transfer drum 5 in the conveyance passage to the transfer drum 5. Therefore, even the recording sheet 4 of high rigidity can be positively held on the transfer drum 5.

Then, the image forming process control means 16 transfers a toner image of each color from the image carrier 1 onto each recording sheet 4 held on the transfer drum 5.

Next, the another embodiment of the invention will be explained below. Referring to FIG. 2, a recording sheet 4 is fed by the sheet feed means 11. Then, the sheet size detecting means 13 detects the size of the recording sheet 4 to be conveyed, and the sheet holding control means 15 determines whether one recording sheet 4 is held or two recording sheets 4 are simultaneously held on the transfer drum 5, according to the size information of the recording sheet 4 sent from the sheet size detecting means 13. In accordance with the above determination of how to hold the recording sheet 4, the transfer drum 5 holds the recording sheet 4 on its surface.

At this time, the sheet type discriminating means 12 discriminates whether or not the surface rigidity of the recording sheet 4 is higher than the reference value. When the recording sheet 4 is a highly rigid sheet such as a sheet of card board, the curl deforming means 14 is operated, and the recording sheet 4 is forcibly curled in accordance with a radius of curvature of the transfer drum 5 in the conveyance passage to the transfer drum 5. Accordingly, even if the rigidity is high, one recording sheet or two recording sheets can be simultaneously held on the transfer drum 5.

Then, the image forming process control means 16 transfers a toner image of each color from the image carrier 1 onto each recording sheet 4 held on the transfer drum 5.

The sheet separating fusing control means 17 controls the sheet separating means 7 so that the recording sheet 4 can be separated from the transfer drum at a point of time when the final color toner image transfer operation is conducted on one recording sheet 4 or two recording sheets 4 which are simultaneously held on the transfer drum or at a point of time when the final color toner image transfer operation is completed. At the same time, the thermal fusing means 8 conducts a fusing operation on the recording sheet 4 that has been separated from the transfer drum.

At this time, when the sheet type discriminating means 12 discriminates that the recording sheet 4 is a sheet of high rigidity, the speed change-over control means 18 is operated, and the rotating speed of the transfer drum 5 and the fusing speed of the thermal fusing means 8 are changed over to a value lower than the normal speed at a point of time when the final color toner image transfer operation has been completed on the recording sheet 4 and before the recording sheet 4 enters the thermal fusing means 8. Therefore, the high toner fusing property can be ensured even when the transfer operation is conducted on a highly rigid recording sheet 4 of large heat capacity.

A recording sheet 4 is fed by the sheet feed means 11. Then, in the conveyance passage of the recording sheet 4 from the sheet feed means 11 to the transfer drum 5, the sheet size detecting means 13 detects the size of the recording sheet 4.

Therefore, even if the size of the recording sheet 4 accommodated in the sheet feed means 11 is not previously discriminated, it can be specified at a point of time when the recording sheet 4 passes through the sheet size detecting means 13 arranged in the sheet conveyance passage.

As a result, the sheet holding control means 15 determines whether one recording sheet 4 is held or two recording sheets 4 are simultaneously held on the photoreceptor drum 5 in accordance with the size information of the recording sheet 4 detected by the sheet size detecting means 13, and the sheet holding control means 15 also controls to hold the recording sheet 4 on the transfer drum 5 in accordance with the determination of holding the recording sheet 4.

The image forming process control means 16 controls the transfer of a toner image of each color from the image carrier 1 onto each recording sheet 4 held on the transfer drum 5.

Referring to an embodiment shown in the accompanying drawings, the present invention will be explained in detail as follows.

Figure 3:
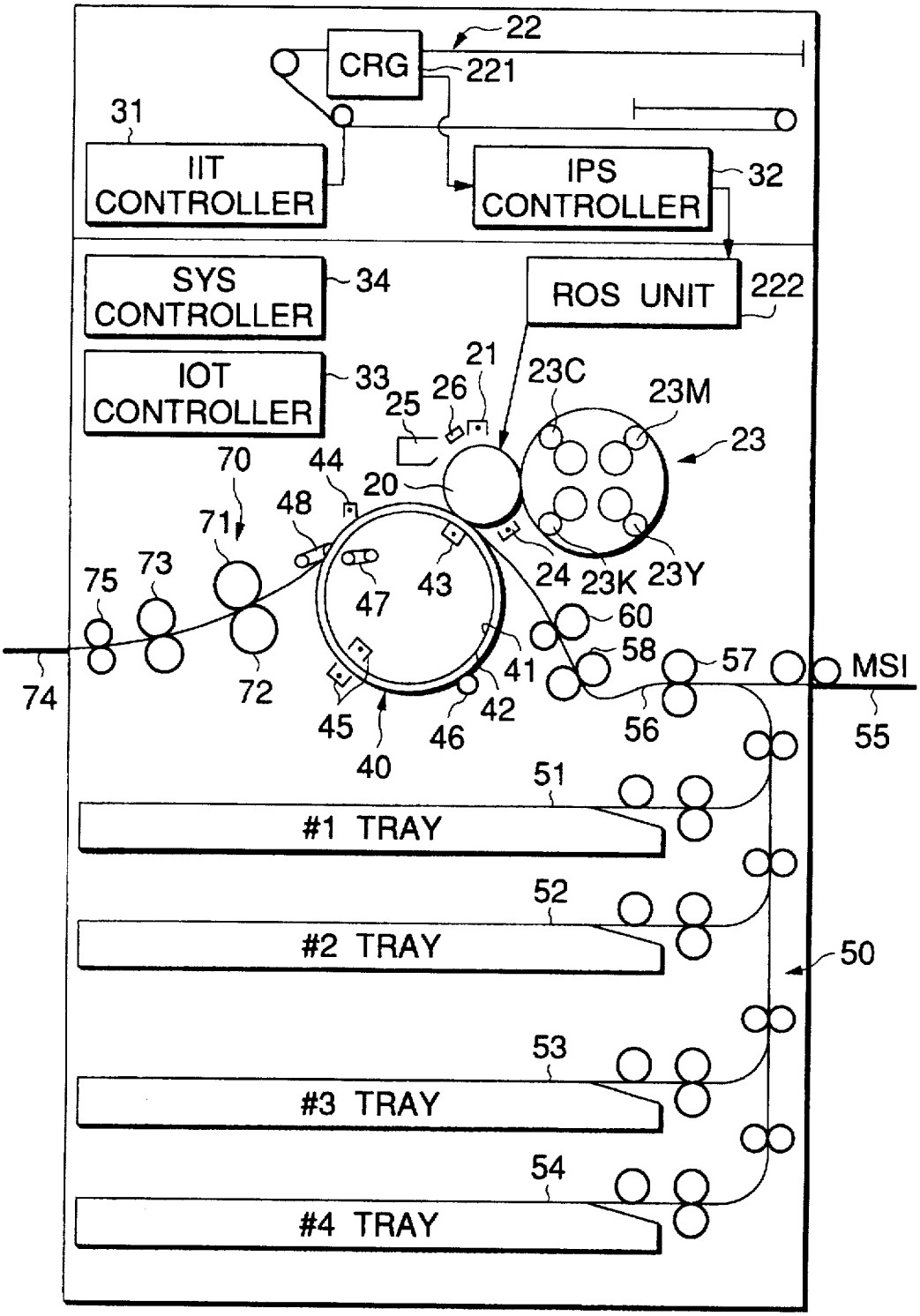
FIG. 3 is a schematic illustration showing an embodiment of the color copier to which the present invention is applied.

FIG. 3 is an arrangement view showing an embodiment of the color copier to which the present invention is applied.

In the drawing, reference numeral 20 is a photoreceptor drum, reference numeral 21 is a charging corotron for previously charging the surface of the photoreceptor drum 20, reference numeral 22 is an exposure scanning system for writing an electrostatic latent image to be formed on the photoreceptor drum 20 that has been electrically charged by the charging corotron 21, reference numeral 23 is a rotary developing device in which four developing units 23K, 23C, 23M, 23Y respectively accommodating toners of black (K), cyan (C), magenta (M) and yellow (Y) are rotatably arranged wherein the four developing units can be appropriately selected, reference numeral 24 is a pretransfer corotron for removing an electric charge on the photoreceptor drum, reference numeral 25 is a cleaner for removing residual toner on the photoreceptor drum, and reference numeral 26 is an erasing lamp for erasing a residual electric charge on the photoreceptor drum 20.

In this embodiment, the exposure scanning system 22 is operated as follows. An exposure carriage 221 to move a document for scanning, which has been set on a platen not shown in the drawing, is controlled by the IIT (Image Input Terminal) controller 31. A component image signal of each color of the document, which has been taken in via the exposure carriage 221, is sent to the laser scanning unit (ROS Unit) 222 via the IPS (Image Processing System) controller 82. In accordance with the image signal of each color component, the laser scanning unit 222 irradiates laser beams onto the photoreceptor drum 20 in the primary scanning direction.

Reference numeral 40 is a transfer drum, on the circumferential surface of which a recording sheet not shown in the drawing such as a sheet of common paper, a sheet of card board, a postcard, an envelope or an OHP sheet is held, and toner images of the color components are successively multiple-transferred onto the recording sheet. This transfer drum is composed in such a manner that a drum frame 41 made of metal is covered with a drum sheet 42 made of polyvinylidene fluoride, and the recording sheet is electrostatically attracted when this drum sheet 42 is electrically charged beforehand. In this connection, the detail of the transfer drum 40 will be described later.

As shown in FIG. 3, the transfer drum 40 includes: a transfer corotron 43 for charging the drum sheet 42 when a recording sheet is held on the transfer drum, and for transferring a toner image from the photoreceptor drum 20 onto the recording sheet; a discharging corotron 44 for discharging the recording sheet after the completion of the transfer process of the final color; a cleaning discharge corotron 45 for removing an electric charge from the drum sheet 42 after the completion of the transfer process of the final color; a cleaning brush 46 for removing paper dust from the drum sheet 42 after the completion of the transfer process of the final color; an inner pushing roller 47 for pushing the drum sheet 42 from the inside when the recording sheet held on the transfer drum 40 is separated; and a separation finger 48 for separating the recording sheet, which has been separated by itself or pushed up by the inner pushing roller 47, from the transfer drum 40.

In this embodiment, the sheet conveyance system 50 includes: a plurality of sheet feed cassettes (#1 tray to #4 tray) 51 to 54; and a hand feed tray (MSI) 55. In the sheet conveyance system 50, a sheet conveyance passage connected to the sheet feed cassettes 51 to 54 and a sheet conveyance passage connected to the hand feed tray 55 are joined to each other in the middle of the sheet conveyance system 50. This sheet conveyance system 50 is extended to an attracting portion on the transfer drum 40 which is the same as a transfer portion in this embodiment. By this sheet conveyance system 50, recording sheets not shown in the drawing are conveyed to the attracting portion on the transfer drum 40 via a predetermined sheet conveyance passage.

In the conveyance passage 56 in which the two conveyance passages are joined, there are provided a preregister roller 57 and a register roller 58. A recording sheet feed operation is conducted by the preregister roller 57, wherein a reference time signal TR0 (generated every half revolution) of the transfer drum 40 is used as a trigger signal. Then, a recording sheet feed operation is conducted by the register roller 58, wherein a reference time signal TR0 generated successively is used as a trigger signal.

In the conveyance passage between the register roller 58 and the attracting portion on the transfer drum 40, there is provided a curl deforming unit 60 for curling a recording sheet of high rigidity such as a sheet of card board. In this connection, the detail of the curl deforming unit 60 will be explained later.

Reference numeral 70 is a fusing unit for fusing a toner image, which has not been fused yet, onto a recording sheet while the recording sheet passes through the fusing unit after the completion of the transfer process. In this embodiment, the fusing unit 70 is composed of a heat roller 71 into which a heater is incorporated, and a pressure roller 72 which is arranged coming into pressure contact with the heat roller 71. Therefore, after a recording sheet has been delivered from the transfer drum 40, it is conveyed to the fusing unit 70 via a guide plate not shown in the drawing. Reference numeral 73 is a fuser delivery roller for the fusing unit to convey the recording sheet which has passed through the fusing unit 70. Reference numeral 74 is a delivery tray in which the recording sheet is accommodated after the completion of fusion. Reference numeral 75 is a delivery roller to deliver the recording sheet onto the delivery tray 74.

Reference numeral 33 is an IOT (Image Output Terminal) controller for controlling an output drive source in accordance with a predetermined sequence of development, transfer and fusion. Reference numeral 34 is an SYS (System Software) controller for demanding various control sequences to the IIT controller 31, IPS controller 32 and IOT controller 33.

Next, the transfer drum 40 used in this embodiment will be explained in detail.

Figure 4A:
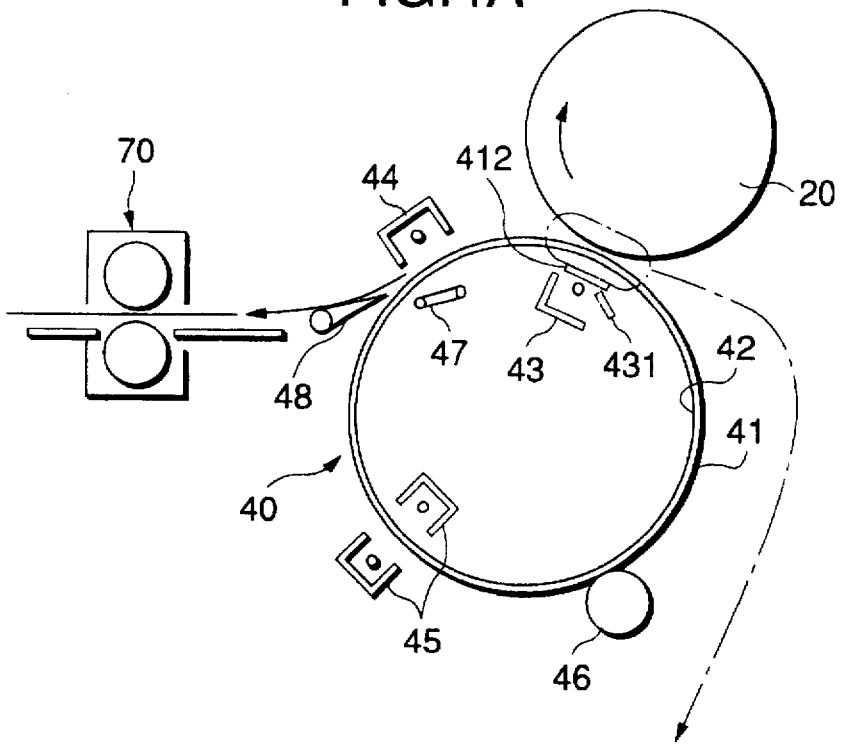
FIGS. 4A and 4B are schematic illustrations showing an arrangement of the transfer drum used in the embodiment of the present invention.
Figure 4B:
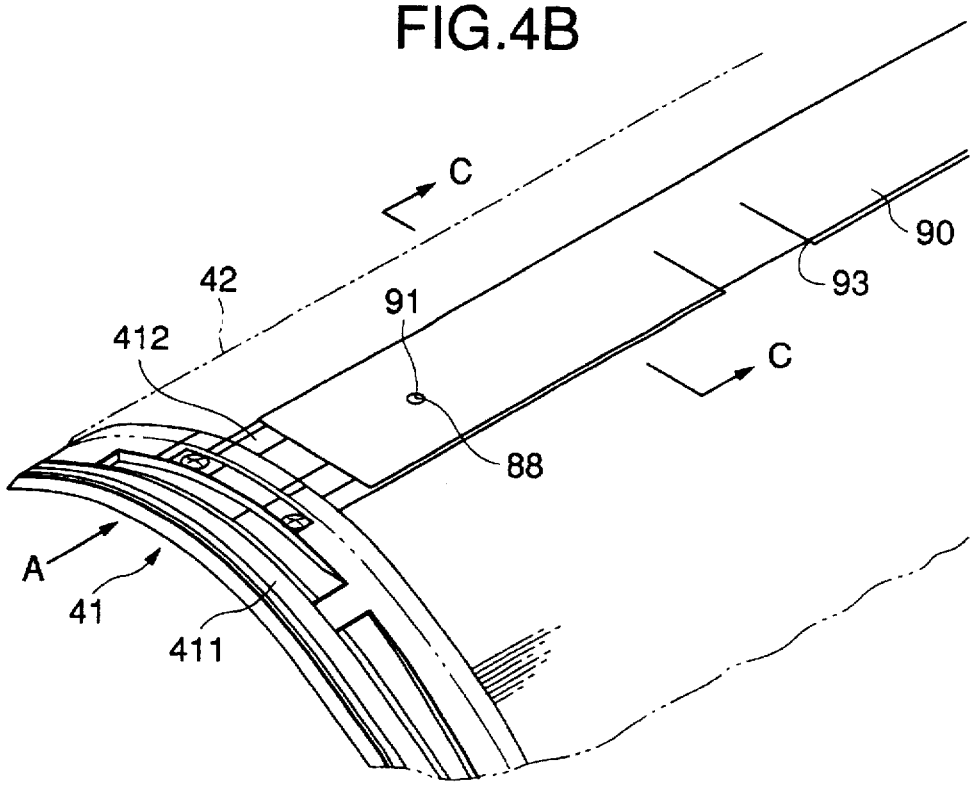

As shown in FIG. 4, this transfer drum 40 has a drum frame 41 in which a pair of ring bodies arranged in parallel are connected with each other by one tie-bar 412. This drum frame 41 is covered with a drum sheet (recording sheet holding member) 42, for example, made of polyvinylidene fluoride.

Figure 5A:
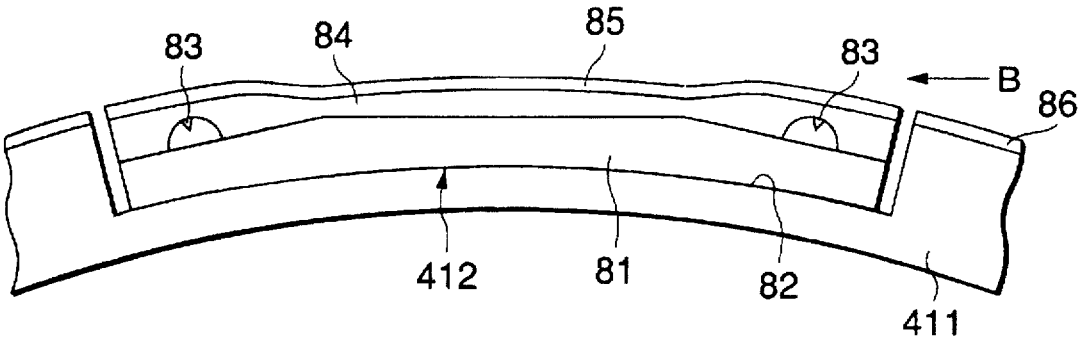
FIG. 5A is a view taken in the direction of arrow A in FIG. 4.
Figure 5B:
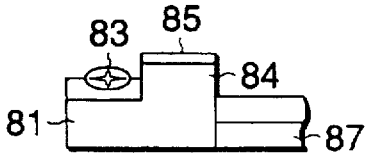
FIG. 5B is a view taken in the direction of arrow B in FIG. 5A.

As shown in FIGS. 5A and 5B, in each ring body 411 of this embodiment, there is formed a supporting groove 82 to be engaged with a connecting portion 81 of the tie-bar 412, wherein this connecting portion 81 is formed at each end of the tie-bar 412. Each connecting portion 81 of the tie bar 412 is attached into the supporting groove 82 by a screw 88.

In this case, the connecting portion 81 of the tie-bar 412 is arranged at a position lower than the supporting groove 82, so that the head of the screw 83 is accommodated in the supporting groove 82.

In a portion of the tie-bar 412 adjacent to the connecting portion 81, there is formed a step portion 84 which is a little lower than the locus of the arc formed by the outer surface of the ring body 411. On the surface of this step portion 84, an adhesive tape 85 is made to adhere. In this connection, on the circumference of the ring body 411, an adhesive tape 86 (shown in FIG. 6C) is made to adhere in such a manner that the adhesive tape 86 is connected to the adhesive tape 85 on the step portion 84.

A portion 87 of the tie-bar 412, not including the connecting portion 81 and the step portion 84, has a surface which is sunken more than the step portion 84.

Figure 5C:
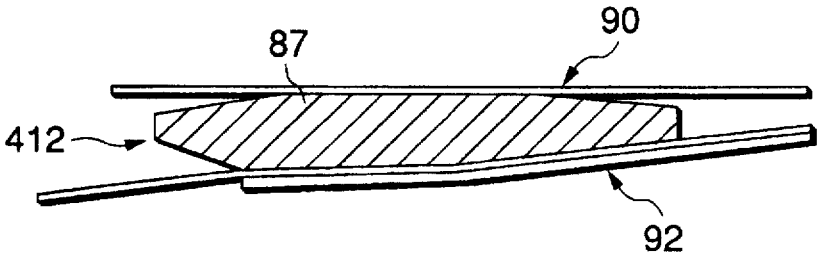
FIG. 5C is a cross-sectional view taken on line C—C in FIG. 4.

As shown in FIGS. 4 and 5C, in this embodiment, a surface side elastic member 90 adheres onto the surface (upper surface) of the inside portion 87 of the tie-bar 412 under the condition that a positioning protrusion 88 of the tie-bar 412 is engaged with a positioning hole 91 of the surface side elastic member 90. The surface of this surface side elastic member 90 is arranged at a position lower than the reverse side of the drum sheet 42.

This elastic member 90 functions in such a manner that it elastically supports the drum sheet 42 from the inside when the drum sheet 42 contracts due to a change in temperature.

As shown in FIGS. 4 and 5C, in this embodiment, on the reverse surface (lower surface) of the inside portion 87 of the step portion 84 of the tie-bar 412, there is provided a reverse side elastic member 92 composed in such a manner that an insulating sheet member made of polyethylene terephthalate adheres onto a sheet member made of Teflon. An end surface of this reverse side elastic member 92 on the downstream side in the circumferential direction extends outside the tie-bar 412 by a distance of 5 to 10 mm, and an end surface of this reverse side elastic member 92 on the upstream side extends outside the tie-bar 412 by a distance of 10 mm.

This reverse side elastic member 92 prevents the vibration and banding of the image writing unit (laser scanning unit) when the baffle 431 of the transfer corotron 43 collides with the tie-bar 412 or when the baffle 431 of the transfer corotron 43 passes under the tie-bar and opens it. In this connection, the baffle 431 of the transfer corotron 43 is provided for the purpose of restricting the transfer discharge region.

The tie-bar 412 is provided with a cutout 93 substantially at the center in the axial direction, and this cutout 93 is used to push up the drum sheet 42 from the inside by the inner pushing roller 47 in the process of separating a recording sheet. In this connection, when the separating motion is started in the process of transfer, this inner pushing roller 47 is operated in timed relation that the vibration caused when the inner pushing roller 47 comes into contact with the drum sheet 42 is not transmitted to the transfer portion and the image is not disturbed.

Next, the drum sheet 42 will be explained as follows.

Figure 6A:
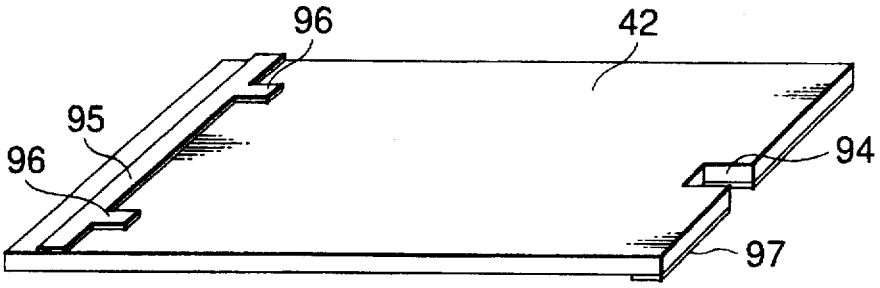
FIG. 6A is a schematic illustration showing an example of the arrangement of the drum sheet.

As shown in FIG. 6A, in this embodiment, the drum sheet 42 is formed into a rectangle, the length of the long side of which is the same as the sum of the circumferential length of a pair of ring bodies 411 (shown in FIG. 4) arranged in parallel with each other and the overlapping length. The length of the short side of the drum sheet 42 is determined to be a value capable of ensuring an adhesive region on the end surface of the ring body 411.

On one end side of the drum sheet 42, there is provided a cutout 94 corresponding to the cutout 93 of the tie-bar 412 (shown in FIG. 4). The reason why the cutout 94 is provided corresponding to the cutout 93 is the necessity of ensuring a gap of 150 μm between the photoreceptor drum 20 and the drum sheet 42 for forming an image patch to control the image density in a portion of the photoreceptor drum 20 opposed to the tie-bar 412 in timed relation with a region except for the transfer region on the drum sheet 42 and also for preventing this image patch from being transferred onto the drum sheet 42.

On the front end side of the drum sheet 42 in the longitudinal direction, on the surface to which a recording sheet is attracted, there is provided an adhesive tape 95, the width of which is 3 mm, at a position distant from the front end by 1 mm. At a position inside the end in the axial direction of the drum sheet 42 distant from the end by several mm, there is provided an adhesive tape 96, the length of which is so small that the rear end of the drum sheet 42 can not overlap the adhesive tape 96 in the circumferential direction. On the other hand, on the rear end side of the drum sheet 42 in the longitudinal direction, there is provided an adhesive tape 97, the length of which is approximately 3 mm, on the reverse side of the drum sheet 42.

The reason why the adhesive tapes 95, 96 are arranged in such a manner that some margins are left between the front end of the drum sheet 42 and the adhesive tapes 95, 96 is that the drum sheet 42 can be easily slid to a predetermined position by giving a very low pressure from the upper side when the rear end of the drum sheet 42 is put on it.

Figure 6B:
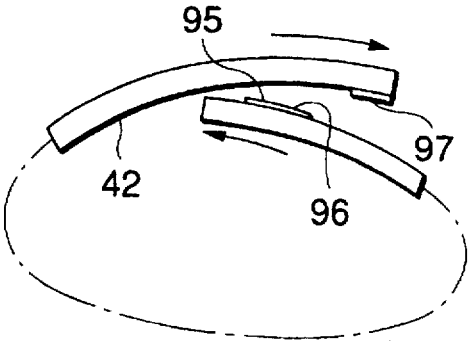
FIG. 6B is a schematic illustration showing the way of fixing the drum sheet.
Figure 6C:
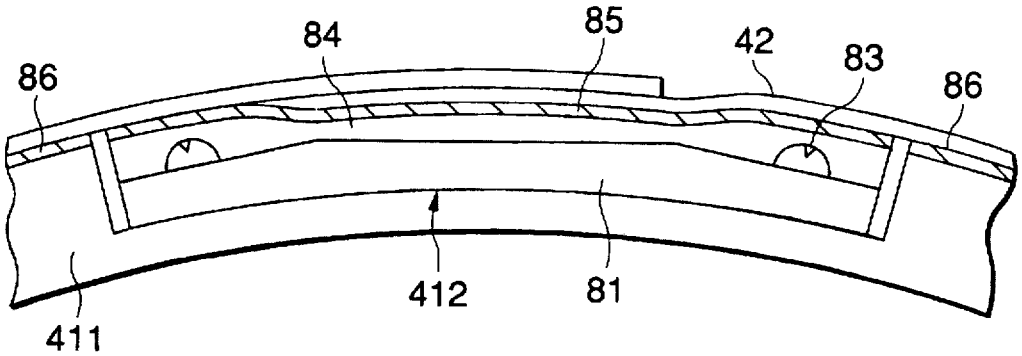
FIG. 6C is a schematic illustration showing a state in which the drum sheet is attached.

In this embodiment, as shown in FIGS. 6A to 6C, the drum sheet 42 is attached to the drum frame 41 as follows. The adhesive tape 86 arranged on the ring body 411 in the axial direction is positioned on the adhesive tape 96 arranged at a position inside the end portion of the drum sheet 42 in the axial direction wherein the distance from the end portion to the adhesive tape 96 is several mm. The front end portion of the drum sheet 42 is made to adhere onto the adhesive tape 86 which adheres on the ring body 41 in the circumferential direction. The ring body 411 is rotated, so that the end portion of the drum sheet 42 in the axial direction is make to adhere to the ring body 411 in the circumferential direction, and then the front end of the drum sheet 42 is put on the rear end.

In this case, the rear end of the drum sheet 42 is put on the front end with pressure in the following manner. The adhesive tape 95 is pressed with the pressure of 0.2 to 0.3 Kg from the center of the rear end of the drum sheet 42 in the axial direction to the ring body 411. After that, the pressure of 0.2 to 0.3 Kg is given from the upper side along the adhesive tapes 96, 97. In this way, the drum sheet 42 is made to adhere.

A region where the drum sheet 42 is made to adhere double is located on the step portion 84 of the tie-bar 412. Accordingly, in the region where the drum sheet is made to adhere double, the thickness of the drum sheet 42 and the thickness of the adhesive tape are accommodated in the supporting groove 82 of the drum frame 41. Therefore, the drum sheet 42 can be made to adhere uniformly onto the outer circumferential surface of the ring body 411.

Figure 7:
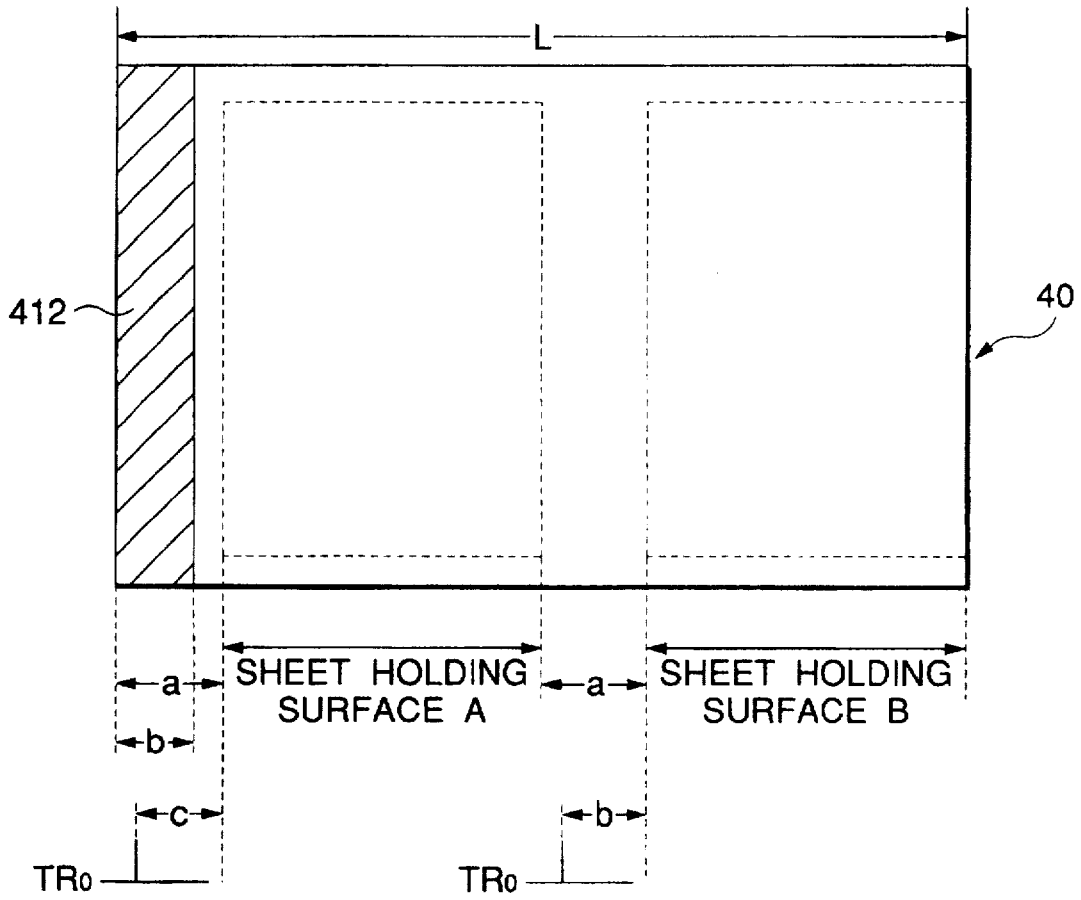
FIG. 7 is a schematic illustration in which the transfer drum is developed.

FIG. 7 is a development view of the thus composed transfer drum 40 which is developed in the circumferential direction. In the drawing, the circumferential length L of the transfer drum 40 is 527.79 mm, the size "b" of the tie-bar 412 in the circumferential direction is 37.9 mm, and the size "a" of the inter image portion in the circumferential direction is 47.9 mm. On the surface of the transfer drum 40 not including the inter image portion, there are provided two sheet holding surfaces A and B, the maximum size of which is approximately 217 mm. In this embodiment, the distance "c" from a position, at which the reference timing signal TR0 is given, to the end portion of the sheet holding surface A or B is set at about 40 mm.

In this embodiment, each developing unit of the rotary developing device 23 is changed over between the inter images.

Figure 8:
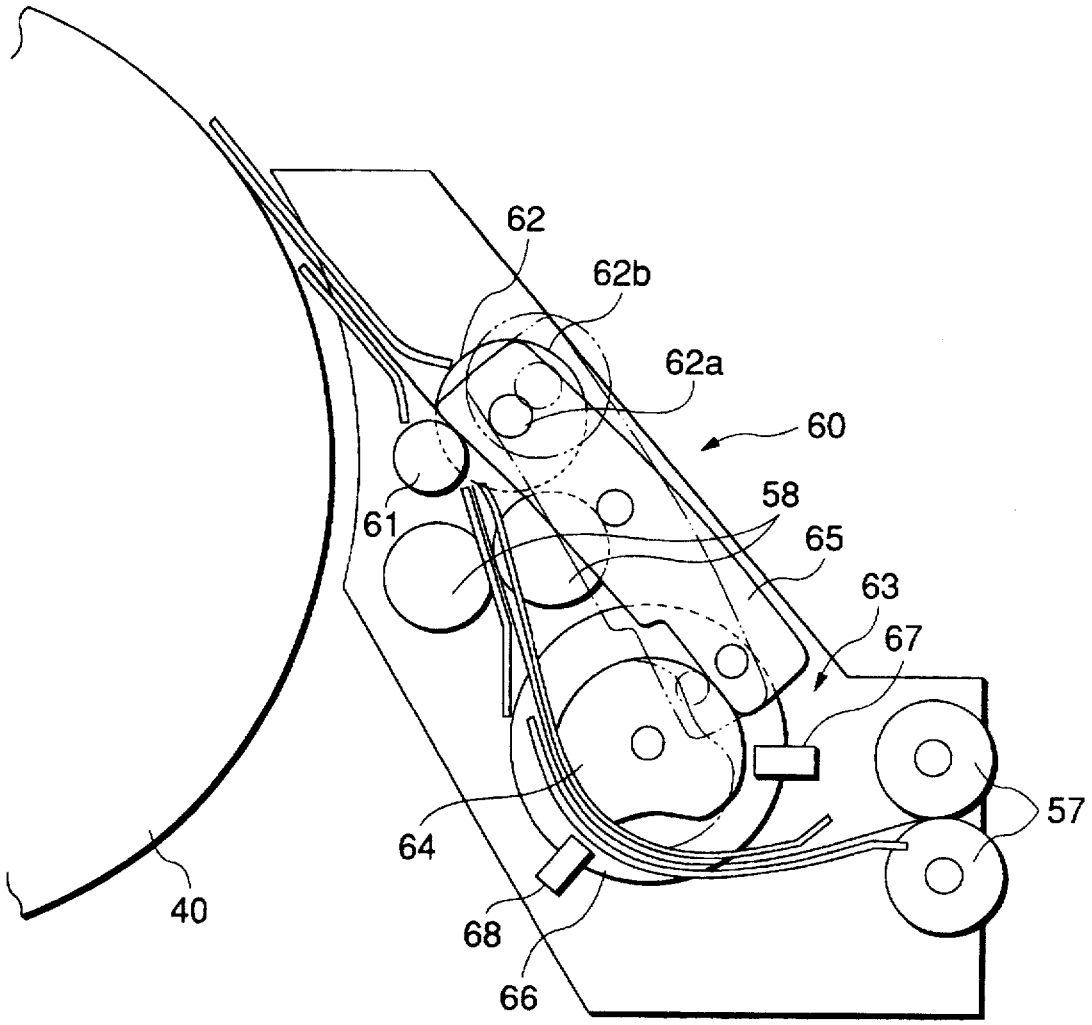
FIG. 8 is a schematic illustration showing a specific example of the curl deforming unit used in the embodiment.

FIG. 8 is a view showing the detail of a curl deforming unit (curler) of this embodiment.

The curl deforming unit 60 shown in the drawing curls a recording sheet in accordance with a radius of curvature of the transfer drum 40. The curl deforming unit 60 includes: a curl drive roller 61 made of metal, the diameter of which is, for example, 12 mm, rotated by a drive force given from a main motor not shown in the drawing; and a curl roller 62, the diameter of which is 26 mm, which is composed in such a manner that a member sponge rubber **62*b*, the hardness of which is 10°, is trained round a metallic shaft 62*a*, the diameter of which is 12 mm. By the action of an adjustable mechanism 63 described later, the curl roller 62 is bitten by the curl drive roller 61. In the mode of card board, an amount of bite of the curl drive roller 61 into the curl roller 62 is 2.7 mm, and in the mode of postcard, an amount of bite of the curl drive roller 61 into the curl roller 62 is 3.5 mm. In this embodiment:, the mode of envelope can be also selected, and the curl deforming unit 60** can be operated in the same manner as that of the mode of card board.

In this embodiment, the adjustable mechanism 63 includes: a cam 64 rotated by a drive force given by a main motor not shown via an electromagnetic clutch not shown; a curl lever 65 rotated in a predetermined range round a fulcrum by the rotation of the cam 64; a detection disk 66, on which cutout portions (not shown) are formed at positions of 120° and 240° with respect to the reference position, rotated in conjunction with the cam 64; photosensors 67, 68 arranged at positions of 120° and 240° on the circumference of the detecting disk 66, to detect the cutout portion on the detecting disk 66 so as to output positional signals corresponding to the three rotary positions of 0°, 120° and 240°; and a control section (not shown) to judge the position of the cam 64 by combining the pulse signals of the photosensors 67, 68, also to rotate the cam 64 via an electromagnetic clutch (not shown) to a position selected from three positions in accordance with the type of a recording sheet inputted by the input means such as a card board mode selection switch or a postcard mode selection switch arranged on the control panel.

Figure 9:
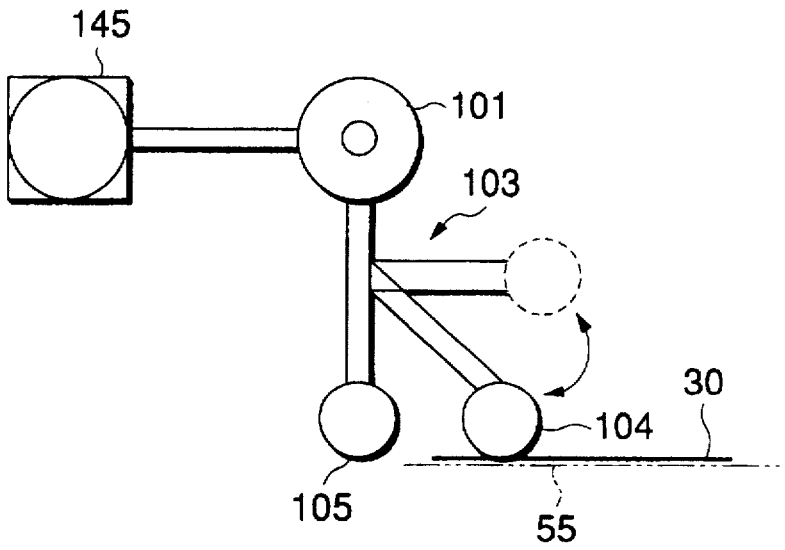
FIG. 9 is a schematic illustration showing the detail of the hand feed tray used in the embodiment.

In this embodiment, the hand feed tray 55 is operated as follows. As shown in FIG. 9, when the feed clutch 101 is turned on, a drive force of the main motor 145 is subjected to the torque limiter 103, so that the major roller 104 is lowered. A recording sheet 30 is pulled in. Then, the recording sheet 30 is sent out by the feed roller 105 one by one.

Figure 10:
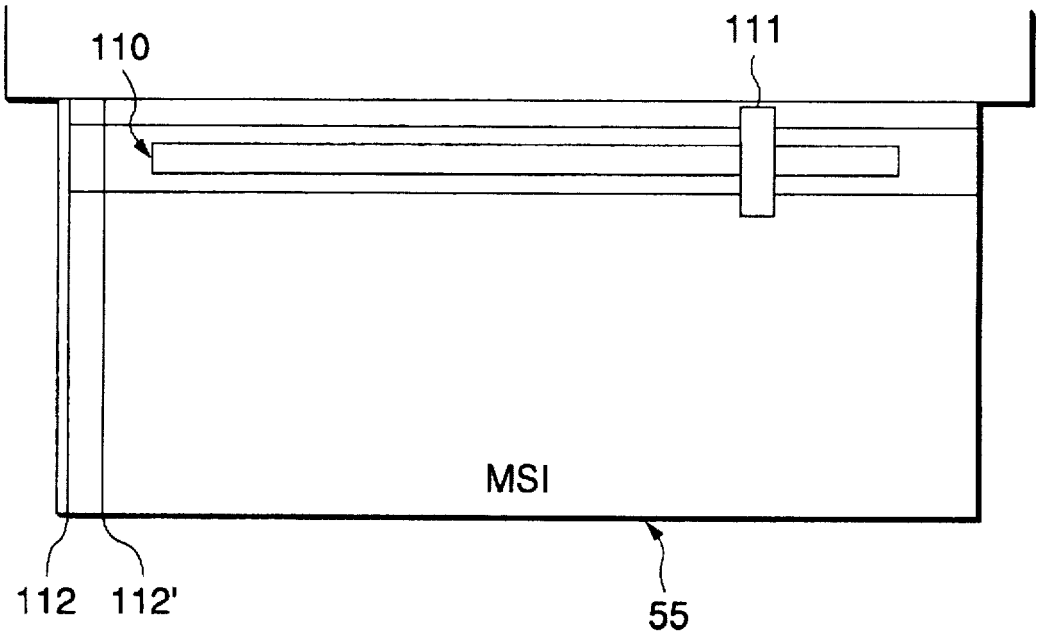
FIG. 10 is a plan view schematically showing the hand feed tray used in the embodiment.

As shown in FIG. 10, the hand feed tray 55 is equipped with a size sensor 110, arranged in the width direction of a recording sheet, to detect the size of the recording sheet in the width direction. When the size sensor 110 detects a position of the side guide 111, it is possible to detect the size of the recording sheet in the width direction.

In this embodiment, the side register 112 for positioning the hand feed tray 55 is arranged at the left end position of the hand feed tray 55 in the drawing. However, in the case of a small-size recording sheet such as a postcard, in order to make it possible to separate the recording sheet from the transfer drum 40, the second side register 112', which is displaced from the left end position of the hand feed tray 55 to the right, is arranged.

Figure 11:
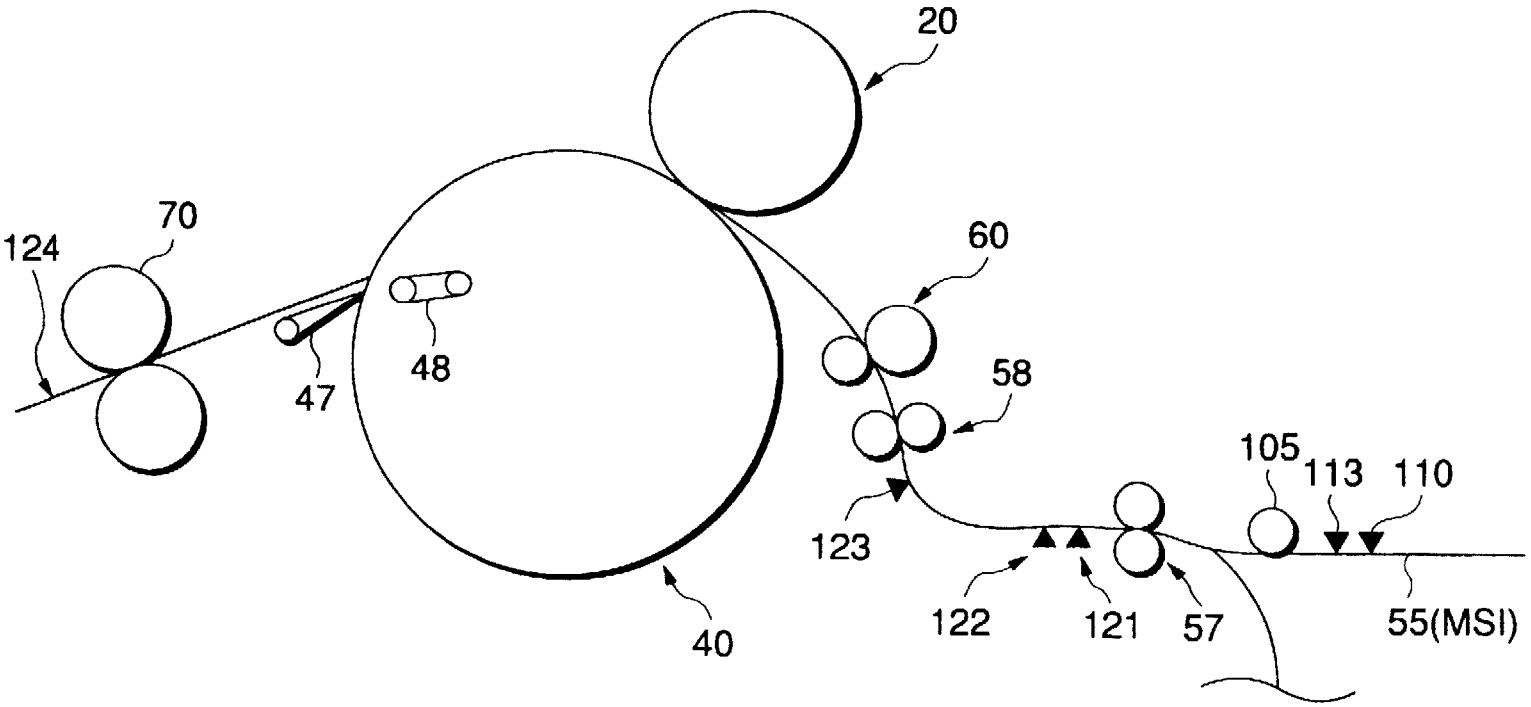
FIG. 11 is a schematic illustration showing a layout of the sensors used in the sheet conveyance system.

Next, referring to FIG. 11 showing this embodiment, sensors used in the sheet conveyance system 50 from the hand feed tray 55 to the transfer drum 40 will be explained below.

In this drawing, the hand feed tray 55 is equipped with a size sensor 110 for detecting the size of a recording sheet in the width direction, and a sheet sensor 113 for detecting the recording sheet. In the conveyance passage arranged immediately after the preregister roller 57, there are provided an OHP sensor 121 for detecting whether or not it is an OHP sheet, and a preregister sensor 122 for detecting the size of the recording sheet in the conveyance direction. In the conveyance passage arranged immediately before the register roller 58, there is provided a register sensor 123 for detecting whether or not the recording sheet has arrived at a position of the register roller 58.

In the conveyance passage arranged immediately after the thermal fusing unit 70, there is provided a fusing unit delivery sensor 124 for detecting a trailing end of the recording sheet that has passed through the thermal fusing unit 70.

Figure 12:
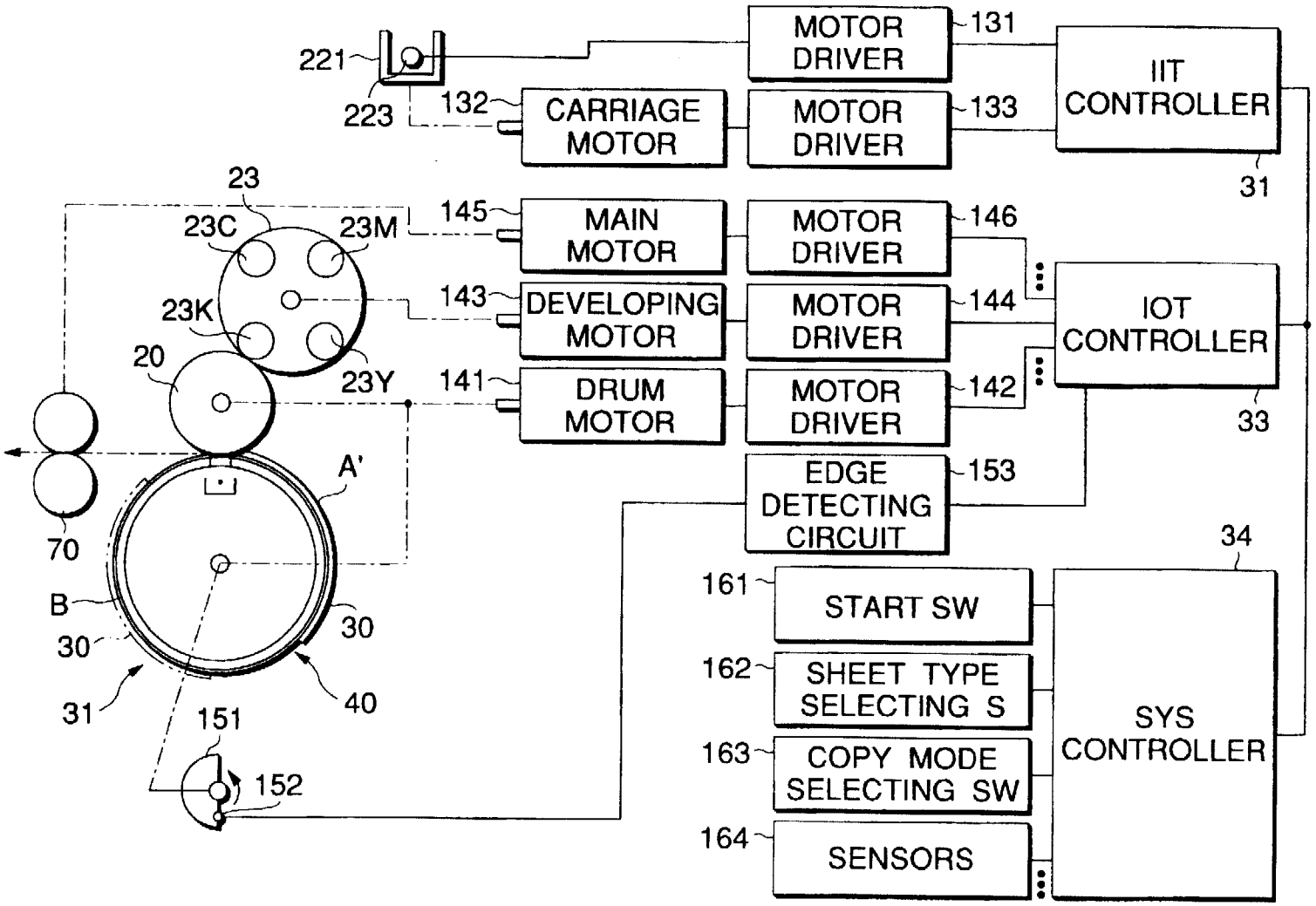
FIG. 12 is a schematic illustration showing a drive control system of the color copier of the embodiment.

FIG. 12 is a view showing a drive control system of the color copier of this embodiment.

In the drawing, reference numeral 131 is a lamp driver for lighting an exposure lamp 223 in the exposure carriage 221, reference numeral 132 is a carriage motor for driving the exposure carriage 221, and reference numeral 133 is a motor driver for the carriage motor 132. The IIT controller 31 controls the lamp driver 131 and the motor driver 133 in accordance with a predetermined exposure sequence.

Reference numeral 141 is a drum motor for synchronously driving the photoreceptor drum 20 and the transfer drum 40, and reference numeral 142 is a motor driver for the drum motor 141. Reference numeral 143 is a developing motor for replacing and driving each developing unit 23K to 23Y of the rotary developing device 23, and reference numeral 144 is a motor driver for the developing motor 143. Reference numeral 145 is a main motor for driving the fusing unit 70 and the sheet conveyance system, and reference numeral 146 is a motor driver for the main motor 145. The IOT controller 33 controls the motor drivers 142, 144, 146 in accordance with a predetermined developing, transferring and fusing sequence.

There is provided a semicircular plate 151 on the same axis of the transfer drum 40. An optical sensor 152 composed of a light emitting and a light receiving section is arranged at a position crossing this semicircular plate 151. The output of the optical sensor 152 is turned on and off every half revolution of the transfer drum 40. A rising point of this optical sensor 152 and a falling point are detected by the edge detecting circuit 153, and a reference timing signal TR0 is outputted every half revolution of the transfer drum 40. This reference timing signal TR0 is inputted into the IOT controller 33.

Reference numeral 161 is a start switch for starting a copying operation, reference numeral 162 is a sheet type selecting switch for selecting the type of sheets according to the mode (the common paper mode or the special mode such as a card board mode, postcard mode, OHP sheet mode and envelope mode), reference numeral 163 is a copying mode selecting switch for selecting the copying mode (the four color mode, three color mode and monocolor mode), and reference numeral 164 represents various sensors such as a preregister sensor 121 and so forth.

In accordance with the input given from each switch and sensor described above, the SYS controller 34 requests the IIT controller 31 and IOT controller 33 to send various control sequences such as an image recording sequence in which one recording sheet or two recording sheets are simultaneously held on the transfer drum and an image recording sequence based on the type of a recording sheet in this embodiment.

Characteristic operation of the color copier of this embodiment will be explained below.

In the case where two recording sheets are simultaneously held on a transfer drum when the recording sheets are fed from a manual feed tray, the characteristic operation will be described as follows.

Setting of Mode of Card Board or Postcard

Figure 13:
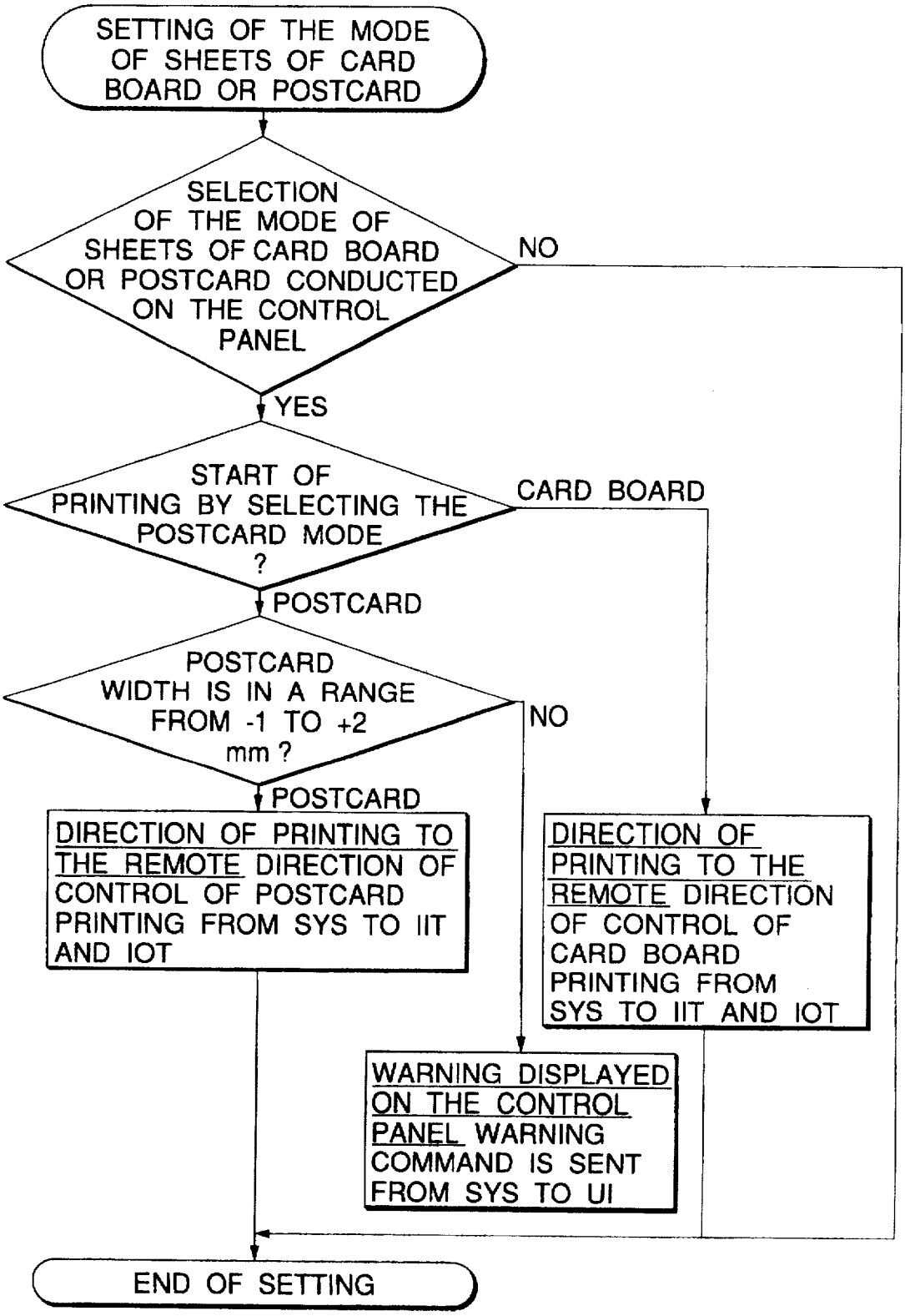
FIG. 13 is a flow chart showing the mode setting of sheets of card board or postcard in the embodiment.

In this embodiment, not only a sheet of common paper but also a sheet of card board or a postcard can be used. When a sheet of card board or a postcard is used, after the sheet of card board or the postcard has been set in the hand feed tray 55, setting of the card board mode or the postcard mode may be conducted as shown in FIG. 13.

That is, one of the card board mode and the postcard mode is selected on the console panel, and the printing start switch is pressed in accordance with the selection.

In the postcard mode, it is checked whether or not the postcard width is in a range from −1 to +2 mm with respect to a predetermined value. When the postcard width is appropriate, the printing command is given to the remote, that is, the SYS controller gives a command of printing to the IIT controller and IOT controller. When the postcard width is not appropriate, a warning sign is displayed on the console panel, that is, the SYS controller sends a warning command to UI (user interface).

In the card board mode, the printing command is immediately given to the remote, that is, the SYS controller gives a card board printing command to the IIT controller and IOT controller.

Figure 14:
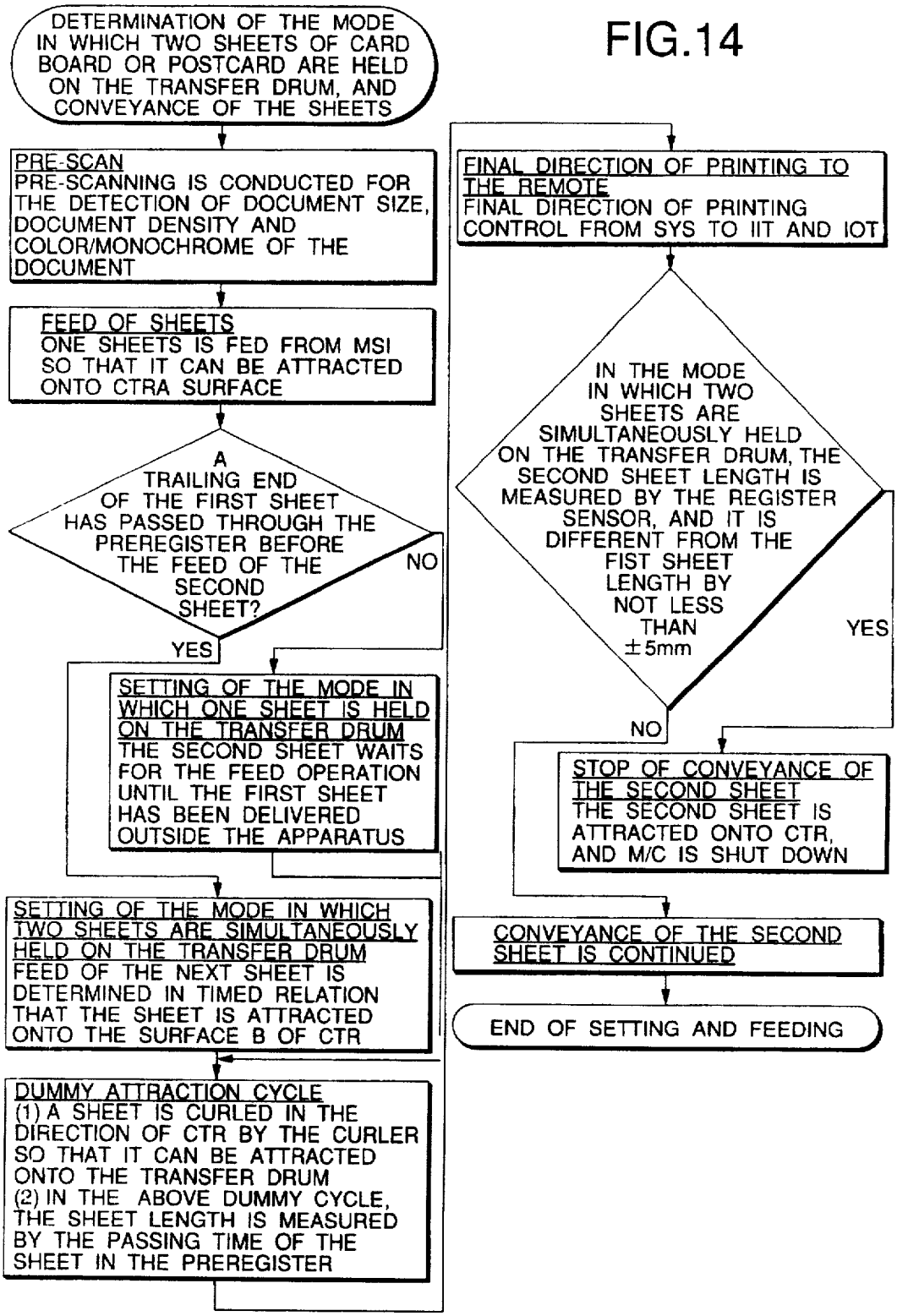
FIG. 14 is a flow chart showing a determination of the mode in which two recording sheets of card board or postcard are simultaneously held on a transfer drum and also showing a conveyance processing of recording sheets.

Determination of Simultaneously Holding Two Recording Sheets of Card Board or Postcard on a Transfer Drum, and Conveyance of Recording Sheets On the assumption that the card board mode or the postcard mode is set, the printing start switch is pressed. Then, as shown in FIG. 14, prescanning is first conducted by the exposure scanning system 22, and the detection of the document size is conducted, and also the detection of color/monochrome of the document is conducted.

Then, one recording sheet is fed from the hand feed tray (MSI) 55 to the transfer drum (CTR) 40.

In this case, a position of the preregister sensor 122 is previously adjusted, so that it can be detected whether or not a trailing end of the first recording sheet has passed through the preregister sensor 122 before the second recording sheet is fed. When the trailing end of the first recording sheet has passed through the preregister sensor 122 before the second recording sheet is fed, the mode in which two recording sheets are simultaneously held on the transfer drum is set, that is, the next recording sheet is fed in timed relation that the recording sheet is attracted onto the surface B on the transfer drum (CTR) 40. On the other hand, when the trailing end of the first recording sheet has not passed through the preregister sensor 122 before the second recording sheet is fed, the mode in which one recording sheet is held on the transfer drum is set, that is, the second recording sheet waits for the successive operation until the first recording sheet is delivered outside the apparatus.

After that, a dummy attracting cycle is conducted.

In this dummy attraction cycle, the following operation is conducted. (1) A recording sheet is appropriately curled by the curler (the curl deforming unit). Therefore, it is possible to attract the recording sheet onto the transfer drum (CTR). (2) In the above dummy attraction cycle, the length of the recording sheet is measured by the passing time in which the recording sheet passes through the register sensor 123.

When this dummy attraction cycle is conducted, the final printing command is given to the remote, that is, the SYS controller gives the final printing control command to the IIT controller and IOT controller.

After that, in the case of simultaneously holding two recording sheets on the transfer drum, the length of the second recording sheet is measured by the register sensor 123, and it is checked whether or not the length of the second recording sheet is different from the length of the first recording sheet by not less than ±5 mm.

When a difference between the length of the second recording sheet and the length of the first recording sheet is smaller than ±5 mm, the second recording sheet is assumed to be the same recording sheet as the first recording sheet, and the conveyance of the second recording sheet is continued.

On the other hand, when a difference between the length of the second recording sheet and the length of the first recording sheet is not less than ±5 mm, the size of the second recording sheet is assumed to be different from the size of the first recording sheet. Then, the conveyance of the second recording sheet is stopped, that is, the second recording sheet is attracted onto the transfer drum (CTR), and the machine (M/C) is shut down.

When the machine (M/C) is shut down at this time, the writing operation conducted by the laser scanning unit is quickly changed to a different size. Due to the foregoing, a region of the transfer drum in which the recording sheet is not held is not stained with toner, and the second recording sheet held on the transfer drum is delivered outside the apparatus as it is.

Figure 18:
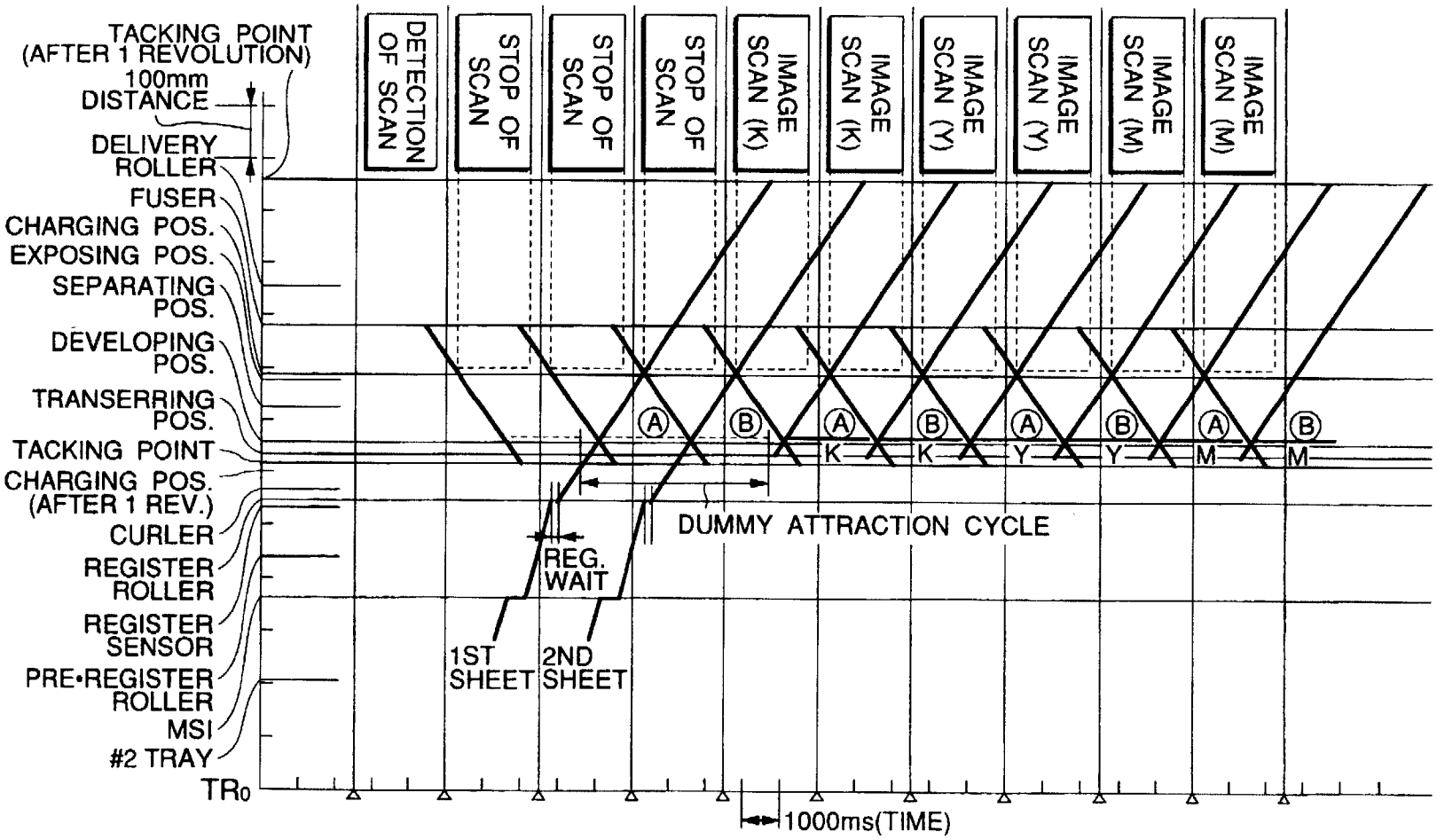
FIG. 18 is a timing chart showing an image recording processing in the embodiment.
Figure 19:
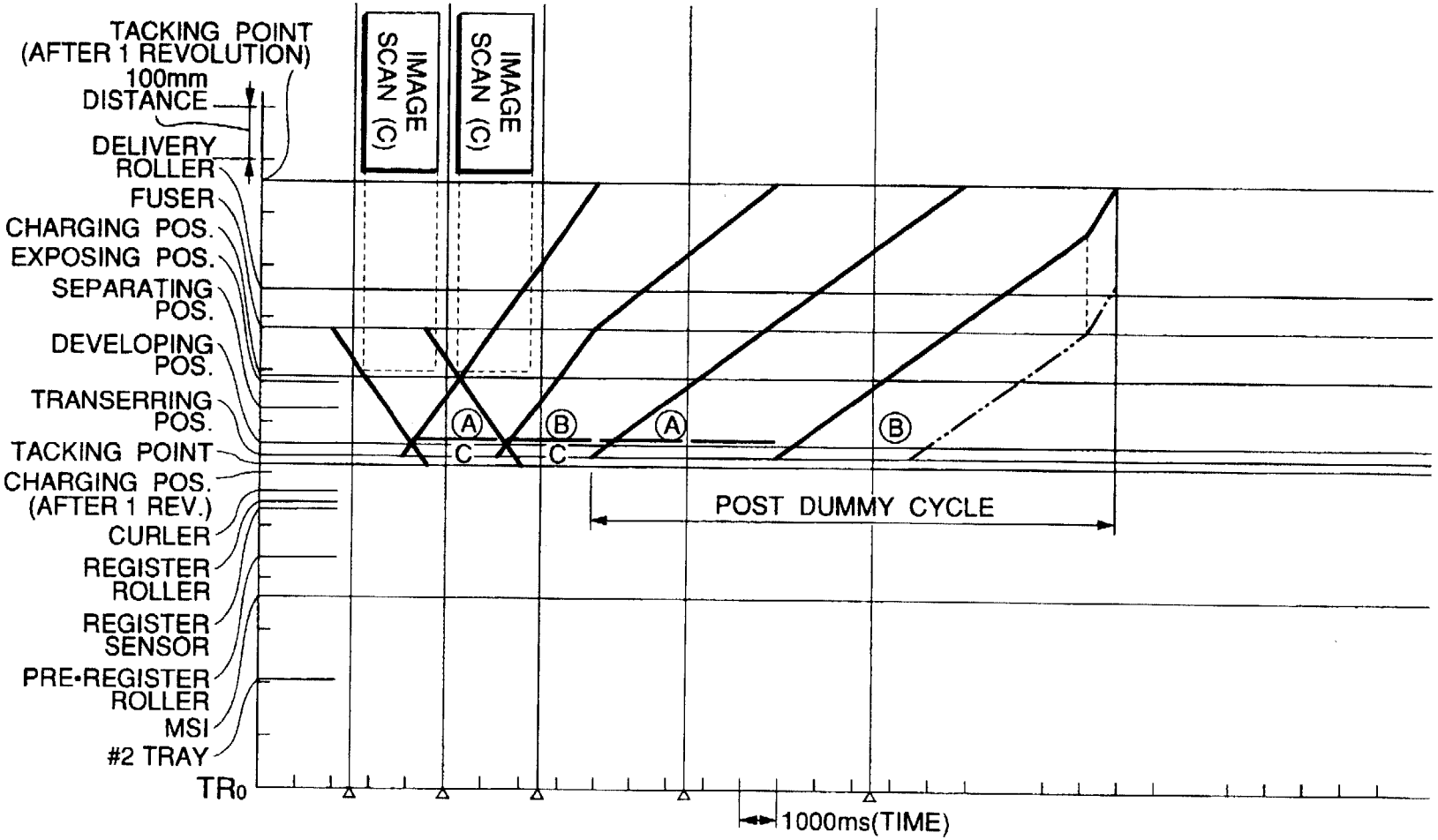
FIG. 19 is a timing chart of the image recording processing to be continued to the timing chart shown in FIG. 18.

FIGS. 18 and 19 are views of the timing charts showing a determination of the mode in which two sheets of card board or two postcards are simultaneously held on a transfer drum and also showing a conveyance processing of recording sheets. In the drawings, the horizontal axis represents a time (unit: ms), and the vertical axis represents a distance (unit: mm) from the reference position (the position of #4 tray) to each functioning section. In the drawings, a straight line extending from the lower left to the upper right represents a locus of sheet conveyance (locus of the end edge), and the straight line extending from the upper left to the lower right represents a locus of the photoreceptor drum. It can be understood that two recording sheets are simultaneously held on the surfaces A and B of the transfer drum 40 in the dummy attracting cycle shown in the drawing.

After the completion of the dummy attracting cycle, image formation of each color (KK: black, YY: yellow, MM: magenta, CC: cyan) is conducted on each recording sheet held on the transfer drum. Therefore, a color toner image is formed on each recording sheet.

Setting of Speed Reduction

Figure 15:
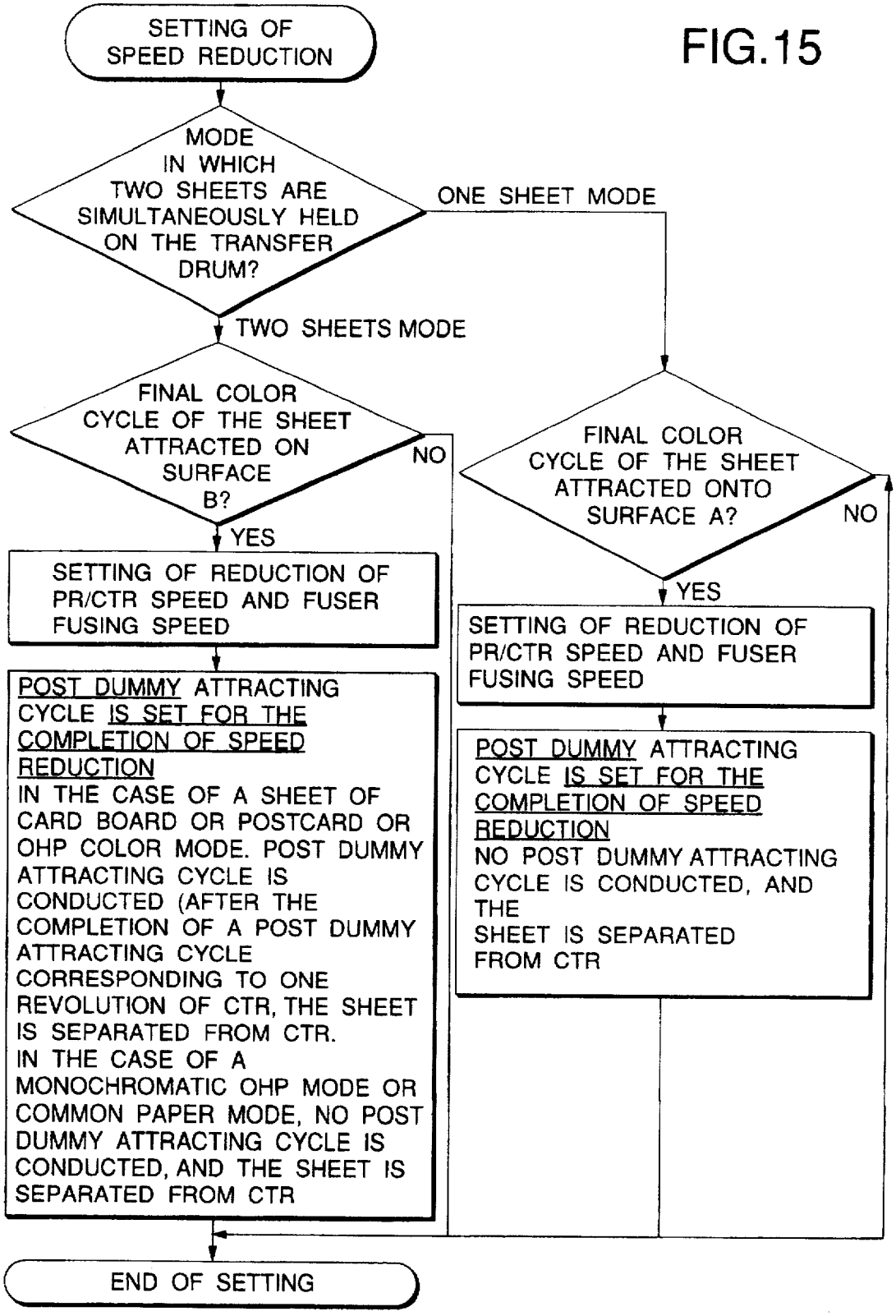
FIG. 15 is a flow chart showing the speed reduction processing in the embodiment.

In this case, it is assumed that image formation of each color component has been conducted in the mode in which two recording sheets are simultaneously held on the transfer drum. After the final color cycle (color cycle of cyan in this embodiment) has been conducted on the recording sheet attracted on the surface B, as shown in FIG. 15, it is set that the speed of the photoreceptor drum (PR)/transfer drum (CTR) and the fusing speed of the fusing unit are reduced.

In this embodiment, the speed is set at 40 mm/sec in the mode of card board or postcard, the speed is set at 70 mm/sec in the color mode of OHP sheets, and the speed is set at 106 mm/sec (normal speed) in the monochromatic mode of OHP sheets or the mode of sheets of common paper.

Figure 16:
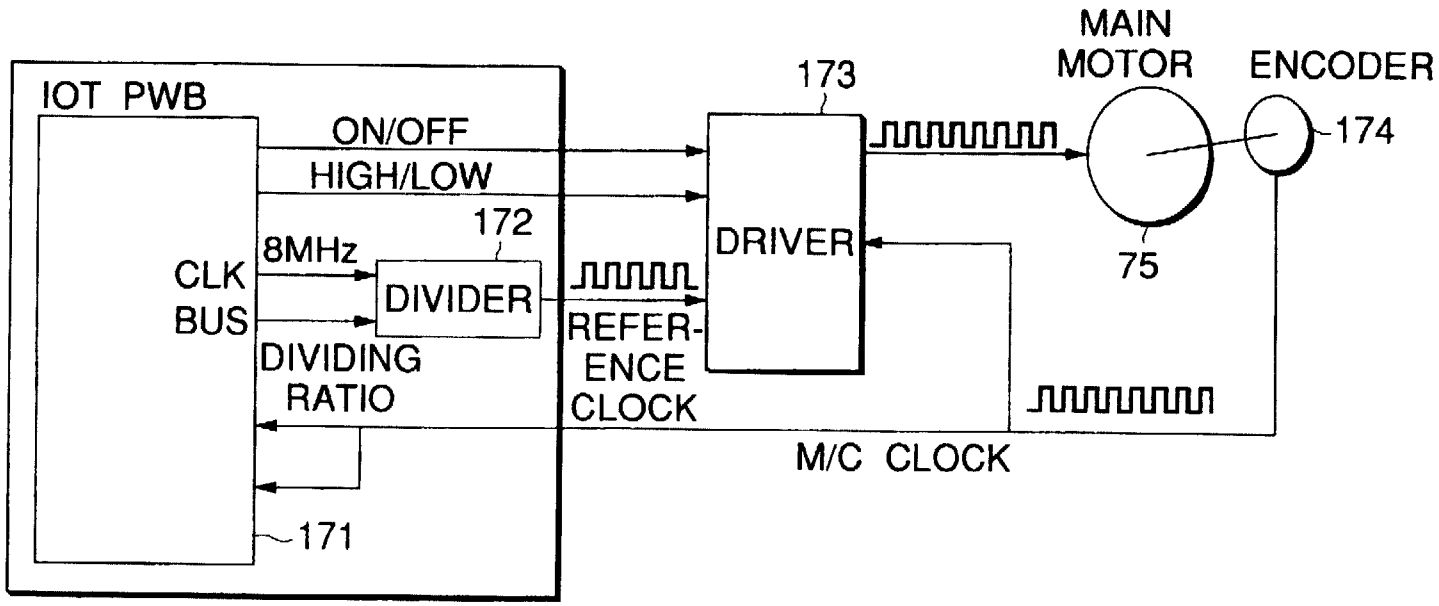
FIG. 16 is a schematic illustration showing an example of the apparatus by which the speed reduction setting processing can be realized in the embodiment.

In order to realize the setting of speed reduction described above, for example, the method shown in FIG. 16 may be adopted.

In the drawing, a dividing ratio, which is different for each mode, corresponding to a predetermined process speed, and a reference clock are inputted into the divider 172 from the CPU 171 of the IOT controller. After a predetermined reference clock has been made by this divider 172, it is outputted into an exclusive driver 173. Servo control of the main motor 145 is conducted by this exclusive driver 173. In this connection, the process speed of the main motor 145 is taken into CPU 171 in the form of a pulse of the encoder 174.

Further, a post-dummy cycle is set for the completion of speed reduction.

In the mode of sheets of card board or postcard, or in the color mode of OHP sheets, the post-dummy cycle is ensured, and the first recording sheet is separated from the transfer drum after the completion of the post-dummy cycle of one revolution of the transfer drum (CTR), and then the second recording sheet and the recording sheets after that are separated from the transfer drum (CTR) in sequence.

On the other hand, in the monochromatic mode of OHP sheets or in the mode of sheets of common paper, without conducting the post-dummy cycle, the first recording sheet is separated from the transfer drum, and then the second recording sheet and the recording sheets after that are separated from the transfer drum in sequence.

In this connection, in this embodiment, the transfer drum (CTR) is rotated by one revolution as a post-dummy cycle. However, from the viewpoint of suppressing the idle rotation of the transfer drum (CTR), the second recording sheet in the process of transfer and the recording sheets after that may be separated from the transfer drum in sequence.

FIG. 19 is a view showing a recording sheet conveyance process in which the speed is reduced as described above.

As shown in FIG. 19, in the post-dummy cycle shown in FIG. 19, it can be understood that the two recording sheets simultaneously held on the transfer drum are separated from the transfer drum under the condition that the speed is reduced, and then the two recording sheets pass through the thermal fusing unit.

In the mode in which one recording sheet is held on the transfer drum, after the final color cycle (the color cycle of cyan in this embodiment) has been conducted on the recording sheet attracted on the surface A, in the same manner as described above, the speed of the photoreceptor drum (PR) /the transfer drum (CTR) and the fusing speed of the fuser (fusing unit) are reduced.

Then the recording sheet is separated from the transfer drum (CTR) without ensuring the post-dummy cycle for the completion of speed reduction.

Setting of Speed Increase

Figure 17:
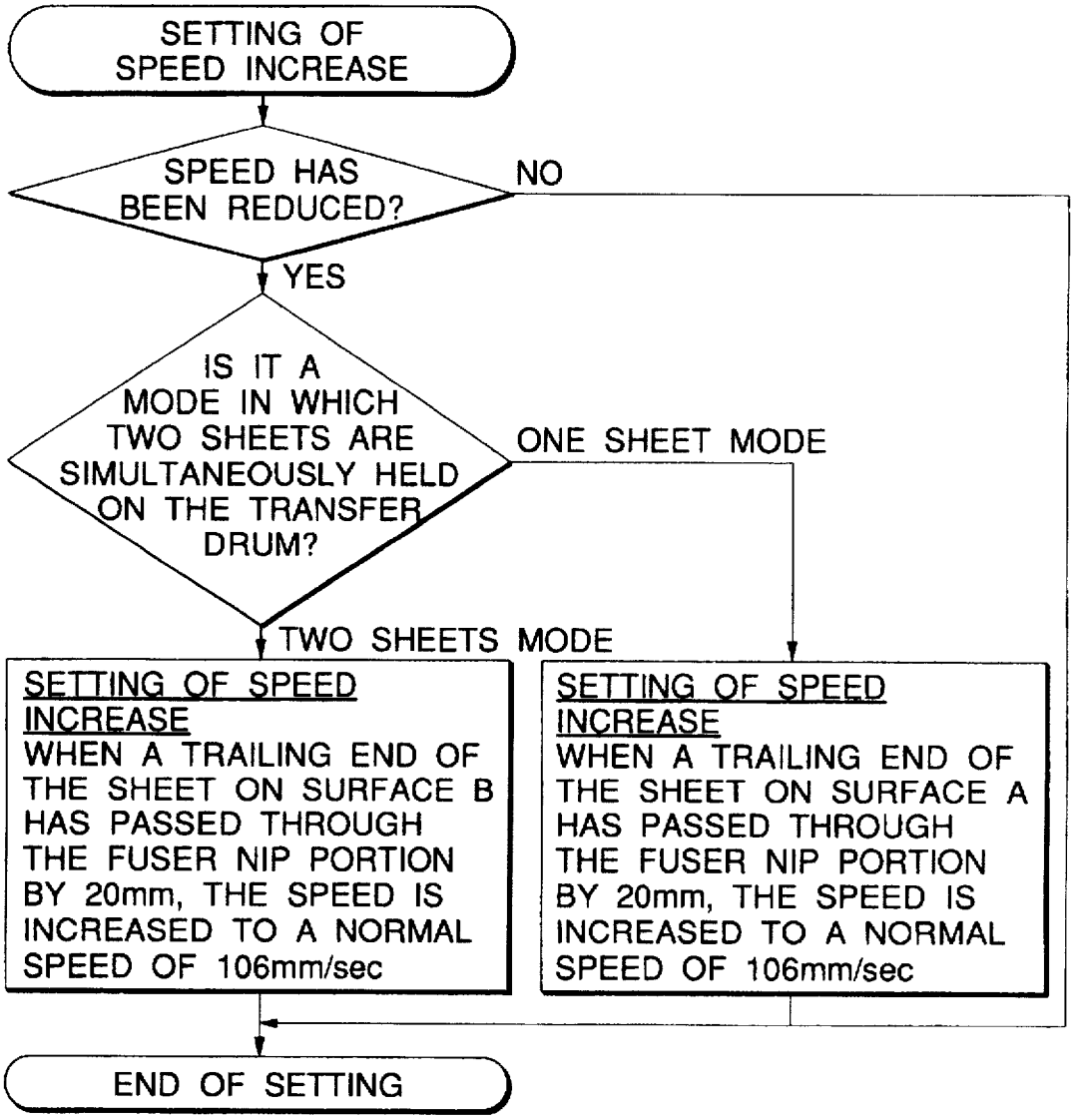
FIG. 17 is a flow chart showing the speed increasing setting processing in the embodiment.

After the completion of speed reduction, the setting of speed increase is conducted as shown in FIG. 17. After the setting of speed reduction has been completed, it is checked whether or not two recording sheets are simultaneously held on the transfer drum. When two recording sheets are simultaneously held on the transfer drum, it is detected by the fuser delivery sensor 124 that a trailing end of the recording sheet held on the surface B has passed through the fuser nip portion by a distance of 20 mm. At this time, the speed is increased to the normal process speed (106 mm/sec).

On the other hand, when one recording sheet is held on the transfer drum, it is detected by the fuser delivery sensor 124 that a trailing end of the recording sheet held on the surface A has passed through the fuser nip portion by a distance of 20 mm. At this time, the speed is increased to the normal process speed (106 mm/sec).

FIG. 19 is a view showing a recording sheet conveyance process conducted in accordance with the setting of speed increase described above.

As shown in the drawing, it can be understood that the speed is increased immediately after a trailing end of the recording sheet held on the surface B (shown by a two-dotted chain line in the drawing) has passed through the fuser nip portion.

Mode of Sheets of Common Paper

When sheets of common paper are used, after they have been set in the hand feed tray 55, the mode of sheets of common paper is selected, and the print start switch is pressed. In this embodiment, the mode of sheets of common paper is automatically selected in the initial selection except when other modes are selected.

Then, the prescanning operation is conducted first by the exposure scanning system 22, and the document size is detected, and also it is detected whether or not the document is color or monochrome.

Next, one recording sheet accommodated in the hand feed tray (MSI) 55 is fed to the transfer drum (CTR) 40.

In this case, before the second recording sheet is fed, it is detected whether or not a trailing end of the first recording sheet has passed through the preregister sensor 122. When the trailing end of the first recording sheet has passed through the preregister sensor 122, the mode in which two recording sheets are simultaneously held on the transfer drum is set, that is, the next recording sheet is fed in timed relation that the next recording sheet is attracted onto the surface B of the transfer drum (CTR). On the other hand, when the trailing end of the first recording sheet has not passed through the preregister sensor 122, the mode in which one recording sheet is held on the transfer drum is set, that is, the second recording sheet waits for the feeding operation until the first recording sheet is delivered outside the apparatus.

After that, the dummy attraction cycle is conducted. Unlike the mode of card board or postcard, the following processing is conducted in this dummy attraction cycle. (1) Without conducting a curling operation on a recording sheet by the curler, the recording sheet is attracted onto the transfer drum (CTR). (2) In this dummy attraction-cycle, the recording sheet length is measured by the passing time of the recording sheet in the register sensor 123.

In the sheet size measuring process, in the mode in which two recording sheets are simultaneously held on the transfer drum, it is checked whether or not a difference between the second sheet length and the first sheet length is not less than ±5 mm.

In this case, when the difference between the second sheet length and the first sheet length is smaller than ±5 mm, the second recording sheet size is assumed to be the same as the first recording sheet size, and the conveyance of the second recording sheet is continued.

On the other hand, when the difference between the second sheet length and the first sheet length is not less than ±5 mm, the second recording sheet size is assumed to be different from the first recording sheet size, and the conveyance of the second recording sheet is stopped, that is, the second recording sheet is attracted onto the transfer drum (CTR), and the machine (M/C) is shut down.

After the dummy attraction cycle described above has been completed, the image forming processing of each color (KK: black, YY: yellow, MM: magenta, CC: cyan) is conducted on each of the two recording sheets which are simultaneously held on the transfer drum. In this way, a color toner image is transferred onto each recording sheet.

When the final color cycle (color cycle of cyan in this embodiment) conducted on the recording sheet attracted on the surface B is completed after that, unlike the mode of card board or postcard, the speed reduction is not conducted on the photoreceptor drum (PR), transfer drum (CTR) and fuser (fusing unit) while the process speed is maintained as it is (the speed is maintained at 106 mm/sec in this embodiment), and the first recording sheet on the surface A and after that are successively separated from the transfer drum (CTR) in sequence and made to pass through the fuser and delivered onto the delivery tray.

Figure 20:
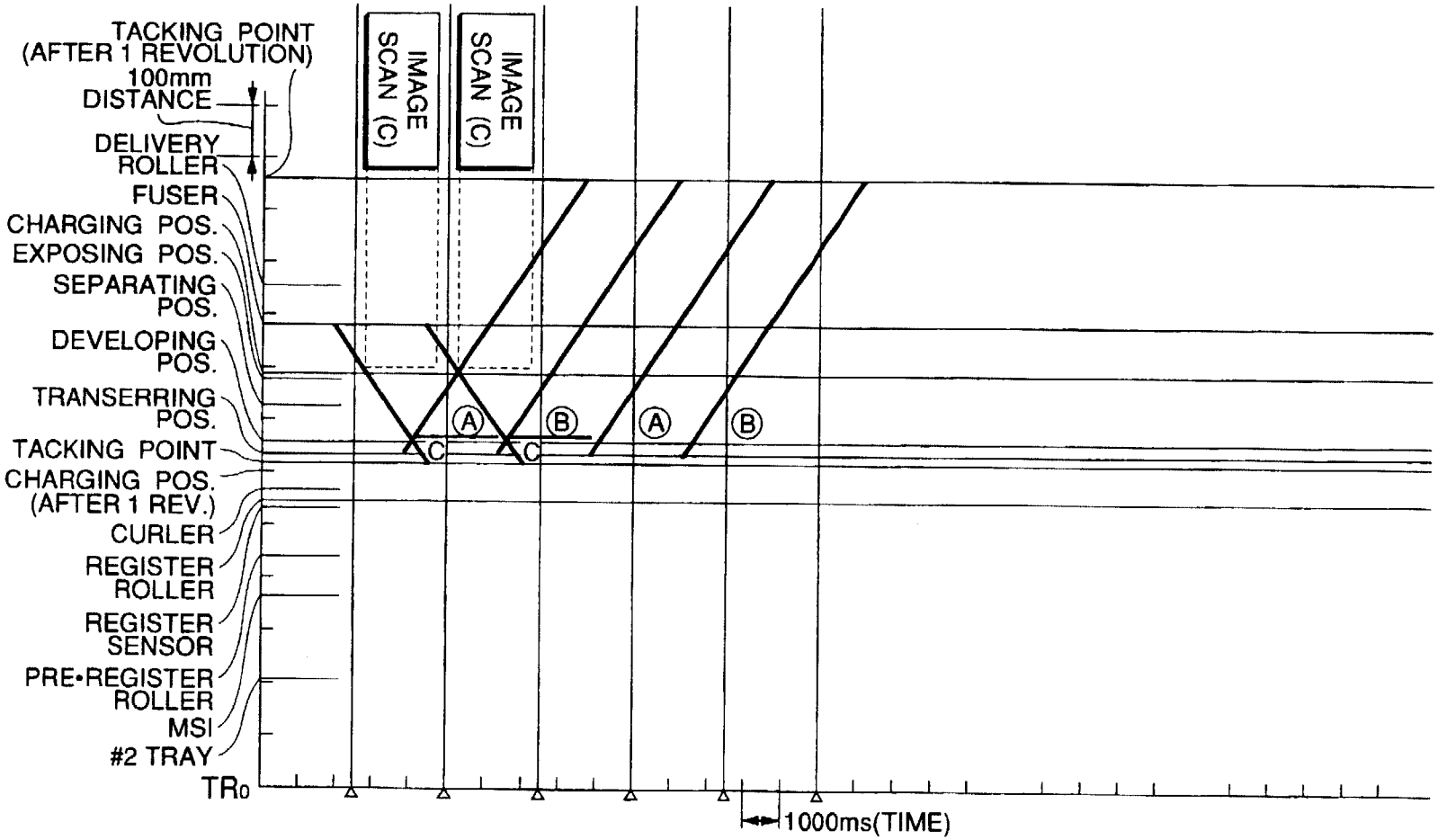
FIG. 20 is a timing chart of the image recording processing of the mode of sheets of common paper to be continued to the timing chart shown in FIG. 18.

FIGS. 18 and 20 are views of the timing charts showing a determination of the mode in which two recording sheets of common paper are simultaneously held on a transfer drum and also showing a conveyance processing of recording sheets. In the drawings, the horizontal axis represents a time (unit: ms), and the vertical axis represents a distance (unit: mm) from the reference position (the position of #4 tray) to each functioning section. In the drawings, a straight line extending from the lower left to the upper right represents a locus of sheet conveyance, and the straight line extending from the upper left to the lower right represents a locus of the photoreceptor drum.

In the case where two recording sheets are simultaneously held on a transfer drum when the recording sheets are fed from a sheet feed cassette, the characteristic operation will be described as follows.

In this embodiment, there is provided a sheet size detecting sensor in the sheet feed cassette. Therefore, it is possible to previously discriminate the size of sheets accommodated in the sheet feed cassette.

Accordingly, for example, when a sheet feed cassette is selected in which recording sheets (sheets of common paper) are accommodated, the size of which is appropriate for the mode in which two recording sheets are simultaneously held on the transfer drum, the printing start switch is pressed. Then, it is possible to immediately discriminate that the sheet size is appropriate for the mode in which two recording sheets are simultaneously held on the transfer drum. Accordingly, without conducting a dummy attracting cycle, the recording sheets in the sheet feed cassette are held on the surfaces A and B on the transfer drum in timed relation earlier than the timed relation of the mode of card board or postcard by a half revolution of the transfer drum.

After that, the image forming processing of each color (KK: black, YY: yellow, MM: magenta, CC: cyan) is conducted on each of the two recording sheets which are simultaneously held on the transfer drum. In this way, a color toner image is transferred onto each recording sheet.

When the final color cycle (color cycle of cyan in this embodiment) conducted on the recording sheet attracted on the surface A is completed after that, while the process speed is maintained as it is (the speed is maintained at 106 mm/sec in this embodiment), the first recording sheet on the surface B and after that are successively separated from the transfer drum (CTR) in sequence and made to pass through the fuser and delivered onto the delivery tray.

In this embodiment, the recording sheet size is detected, and the mode in which two recording sheets are simultaneously held on the transfer drum or the mode in which one recording sheet is held on the transfer drum is carried out in accordance with the recording sheet size. It is possible to adopt another embodiment described as follows. For example, in an image forming apparatus that adopts only the mode in which one recording sheet is held on the transfer drum, after a recording sheet of high rigidity such as a sheet of card board or postcard has been curled by the curl deforming unit (curler), the recording sheet concerned may be held on the surface A of the transfer drum so as to conduct image recording.

As explained above, according to the first aspect of the invention, even when a recording sheet of high rigidity is processed, the recording sheet concerned is curled, and image recording is conducted under the condition that the recording sheet is held on the same sheet holding surface of the transfer drum as the sheet holding surface on which a sheet of common paper is held. Consequently, even if a recording sheet of high rigidity is processed, the applicable size range can be extended, and the processing can be conducted in the same manner as that of a sheet of common paper. Therefore, the image formation process control can be conducted in common.

According to the second aspect of the invention, in the case of a recording sheet of high rigidity, when the size of the recording sheet is small, it is curled, and image recording can be conducted on the recording sheet under the condition that two recording sheets are simultaneously held on the transfer drum. Accordingly, the productivity of image recording with respect to recording sheets of high rigidity can be enhanced.

According to the third aspect of the invention, in addition to the effect of the second invention, when a recording sheet of high rigidity, the heat capacity of which is large, is processed, the recording sheet on which the final image forming cycle is being conducted is separated from the transfer drum, and immediately after the completion of the final image forming cycle, the speed of the transfer drum and the speed of the thermal fusing unit are changed over to speeds which are lower than the normal speed. Therefore, the toner fusing property can be maintained high without providing an exclusive transport means.

According to the fourth aspect of the invention, there is provided a sheet size detecting means in the sheet conveyance passage from the sheet feed means to the transfer drum. According to the recording sheet size information detected by this sheet size detecting means, it is determined in the recording sheet conveyance process whether or not it is possible to adopt the mode in which two recording sheets are simultaneously held on the transfer drum. Therefore, even if the recording sheet size can not be previously discriminated because the size is various in the case of a hand feed tray, it is possible to realize the mode in which two recording sheets are simultaneously held on the transfer drum even with respect to a sheet sent from the hand feed tray. Accordingly, an applicable range of the mode in which two recording sheets are simultaneously held on the transfer drum can be extended.

What is claimed is:

1. An image recording apparatus comprising:

an image carrier;

latent image forming means for successively forming an electrostatic latent image of each color component on the image carrier;

a plurality of developing means for containing toner of each color component, selectively arranged around the image carrier;

a transfer drum having a sheet holding surface on which a recording sheet is held, rotated synchronously with the image carrier so that a recording sheet can be held on the sheet holding surface;

transfer means for transferring a toner image of each color from the image carrier onto the recording sheet held by the transfer drum;

sheet feed means for successively feeding the recording sheet stacked on it;

sheet type discriminating means for discriminating whether or not the surface rigidity of the recording sheet stacked on the sheet feed means is higher than the reference surface rigidity;

curl deforming means arranged in a conveyance passage of the recording sheet from the sheet means to the transfer drum for forcibly curling the sheets in accordance with a radius of curvature of the transfer drum when it is discriminated by the sheet type discriminating means that the recording sheet is highly rigid;

sheet holding control means for holding the recording sheet on the same sheet holding surface of the transfer drum irrespective of the result of discrimination conducted by the sheet type discriminating means; and image forming process control means for controlling the transfer of the toner image of each color from the image carrier onto the recording sheet held on the transfer drum.

2. The apparatus of claim 1, wherein the recording sheet is held on the transfer drum by one of a gripper and an electrostatic force.

3. The apparatus of claim 1, wherein a degree of curl may be adjusted by the curl deforming means in accordance with a change in environmental factors.

4. An image recording apparatus comprising:

an image carrier;

latent image forming means for successively forming an electrostatic latent image of each color component on the image carrier;

a plurality of developing means for containing toner of each color component, selectively arranged around the image carrier;

a transfer drum having two semicircular sheet holding surfaces on which two recording sheets are held, rotated synchronously with the image carrier so that one or two recording sheets can be held on the sheet holding surfaces;

transfer means for transferring a toner image of each color from the image carrier onto the recording sheet held by the transfer drum;

an image carrier;

sheet feed means for successively feeding the recording sheet stacked on it;

sheet type discriminating means for discriminating whether or not the surface rigidity of the recording sheet stacked on the sheet feed means is higher than the reference surface rigidity;

sheet size detecting means for detecting a size of the recording sheet fed from the sheet feed means;

curl deforming means arranged in a conveyance passage of the recording sheet from the sheet feed means to the transfer drum, for forcibly curling the recording sheet in accordance with a radius of curvature of the transfer drum when it is discriminated by the sheet type discriminating means that the recording sheet is highly rigid;

sheet holding control means for determining whether one or two recording sheets are held on the transfer drum in accordance with the size information of the recording sheet detected by the sheet size detecting means, the sheet holding control means also controlling to hold the recording sheet on the transfer drum in accordance with the determination of holding the recording sheet; and image forming process control means for controlling the transfer of the toner image of each color from the image carrier onto the recording sheet held on the transfer drum.

5. The apparatus of claim 4, wherein the recording sheet is held on the transfer drum by one of a gripper and an electrostatic force.

6. The apparatus of claim 4, wherein a degree of curl may be adjusted by the curl deforming means in accordance with a change in environmental factors.

7. An image forming recording apparatus comprising:

an image carrier;

latent image forming means for successively forming an electrostatic latent image of each color component on the image carrier;

a plurality of developing means for containing toner of each color component, selectively arranged around the image carrier;

a transfer drum having two semicircular sheet holding surfaces on which two recording sheets are held, rotated synchronously with the image carrier so that one or two recording sheets can be held on the sheet holding surfaces;

transfer means for transferring a toner image of each color from the image carrier onto the recording sheet held by the transfer drum;

sheet separating means for separating the recording sheet, onto which the toner image of each color has been transferred by the transfer means, from the transfer drum;

thermal fusing means for fusing the toner image of each color formed on the recording sheet separated from the transfer drum by the sheet separating means;

sheet feed means for successively feeding the recording sheet stacked on it;

sheet type discriminating means for discriminating whether or not the surface rigidity of the recording sheet stacked on the sheet feed means is higher than the reference surface rigidity;

sheet size detecting means for detecting a size of the recording sheet fed from the sheet feed means;

curl deforming means arranged in a conveyance passage of the recording sheet form the sheet feed means to the transfer drum, for forcibly curling the recording sheet to be conveyed in accordance with a radius of curvature of the transfer drum when it is discriminated by the sheet type discriminating means that the recording sheet is highly rigid;

sheet holding control means for determining whether one or two recording sheets are held on the transfer drum in accordance with the size information of the recording sheet detected by the sheet size detecting means, the sheet holding control means also controlling to hold the recording sheet on the transfer drum in accordance with the determination of holding the recording sheet;

image forming process control means for controlling the transfer of the toner image of each color from the image carrier onto the recording sheet held on the transfer drum;

sheet separating fusing control means for controlling to separate the recording sheet by the sheet separating means at a point of time when the final color toner image is being transferred onto one or two recording sheets on the transfer drum or at a point of time when the transfer of the final color toner image onto one or two recording sheets on the transfer drum has been completed, the sheet separating fusing control means also controlling to fuse the toner image by the thermal fusing means; and speed change-over control means for operating when the sheet type discriminating means has discriminated that the recording sheet is highly rigid, the speed change-over control means also for changing over the rotating speed of the transfer drum and the fusing speed of the thermal fusing means to a speed lower than the normal speed at a point of time when the final color toner image has been transferred onto the recording sheet and before the recording sheet enters the thermal fusing means.

8. The apparatus of claim 7, wherein the recording sheet is held on the transfer drum by one of a gripper and an electrostatic force.

9. The apparatus of claim 7, wherein a degree of curl may be adjusted by the curl deforming means in accordance with a change in environmental factors.

10. The apparatus of claim 7, wherein the separation means includes one of a separation finger, a coroton and a roller for separator the recording sheet from the transfer drum.

11. The apparatus of claim 7, wherein a recording speed is returned to a normal process speed immediately after the image is fused onto the recording sheet.

12. An image recording apparatus comprising:

an image carrier;

a latent image forming means for successively forming an electrostatic latent image of each color component on the image carrier;

a plurality of developing means for containing toner of each color component, selectively arranged around the image carrier;

a transfer drum having two semicircular sheet holding surfaces on which two recording sheets are held, rotated synchronously with the image carrier so that one or two recording sheets can be held on the sheet holding surfaces;

transfer means for transferring a toner image of each color from the image carrier onto the recording sheet held by the transfer drum;

sheet feed means for successively feeding the recording sheet stacked on it;

sheet type discriminating means for discriminating whether the surface rigidity of the recording sheet stacked on the sheet feed means is higher than the reference surface rigidity;

sheet size detecting means arranged in a conveyance passage of the recording sheet between the sheet feed means and the transfer drum, for detecting the size of the recording sheet conveyed by the sheet feed means;

curl deforming means for forcibly curling the recording sheet to be conveyed in accordance with a radius of curvature of the transfer drum when the rewinding sheet is highly rigid;

sheet holding control means for determining whether one or two recording sheets are held on the transfer drum in accordance with the size information of the recording sheet detected by the sheet size detecting means, the sheet holding control means also controlling the holding of the recording sheet on the transfer drum in accordance with the determination of whether one or two recording sheets are held on the transfer drum;

image forming process control means for controlling the transfer of the toner image of each color from the image carrier onto the recording sheet held on the transfer drum; and sheet separating fusing control means for controlling a separation of the recording sheet by the sheet separating means when a final color toner is transferred onto the recording sheet.

13. The apparatus of claim 12, wherein a degree of curl may be adjusted by the curl deforming means in accordance with a change in environmental factors.

14. The apparatus of claim 12, wherein the recording sheet is held on the transfer drum by one of a gripper and an electrostatic force.

15. The apparatus of claim 12, wherein a recording speed is returned to a normal process speed immediately after the image is fused onto the recording sheet.

* * * * *